US010932514B2

(12) United States Patent
Ide et al.

(10) Patent No.: US 10,932,514 B2
(45) Date of Patent: Mar. 2, 2021

(54) PROTECTIVE SPORTS HELMET

(71) Applicant: Riddell, Inc., Des Plaines, IL (US)

(72) Inventors: Thad M. Ide, Des Plaines, IL (US); Ralph J. Infusino, Des Plaines, IL (US); Nelson Kraemer, Des Plaines, IL (US); Christopher R. P. Withnall, Nepean (CA); Timothy D. Bayne, Nepean (CA)

(73) Assignee: Riddell, Inc., Des Plaines, IL (US)

( * ) Notice: Subject to any disclaimer, the term of this patent is extended or adjusted under 35 U.S.C. 154(b) by 0 days.

(21) Appl. No.: 16/208,082

(22) Filed: Dec. 3, 2018

(65) Prior Publication Data

US 2019/0098954 A1 Apr. 4, 2019

Related U.S. Application Data

(60) Continuation of application No. 14/605,765, filed on Jan. 26, 2015, now Pat. No. 10,143,257, which is a (Continued)

(51) Int. Cl.

| | |
|---|---|
| ***A42B 3/12*** | (2006.01) |
| ***A42B 3/20*** | (2006.01) |
| ***A42B 3/08*** | (2006.01) |

(52) U.S. Cl.

CPC ..... *A42B 3/125* (2013.01); *A42B 3/08* (2013.01); *A42B 3/12* (2013.01); *A42B 3/20* (2013.01); *Y10T 403/54* (2015.01)

(58) Field of Classification Search

CPC .. A42B 3/125; A42B 3/00; A42B 3/08; A42B 3/12; A42B 3/16; A42B 3/18; A42B 3/20

See application file for complete search history.

(56) References Cited

U.S. PATENT DOCUMENTS

| | | | |
|---|---|---|---|
| 622,677 | A | 4/1899 | Gallagher |
| 1,060,220 | A | 4/1913 | White |

(Continued)

FOREIGN PATENT DOCUMENTS

| | | |
|---|---|---|
| CA | 100226 | 7/1906 |
| CH | 692011 | 1/2002 |

(Continued)

OTHER PUBLICATIONS

Riddell 1990 Football Catalog (32 pages).

(Continued)

*Primary Examiner* — Danny Worrell

(74) *Attorney, Agent, or Firm* — Barnes & Thornburg LLP

(57) ABSTRACT

A football helmet includes a plastic shell with side regions having an ear flap with a face guard connector, an ear opening, a slot, and a snap connector. The helmet also includes an internal padding assembly removably connected to the plastic shell and including a jaw pad with a force attenuating layer. When the helmet is worn, a front edge of the jaw pad is positioned both in front of a coronal plane and below a basic plane of a head of the helmet wearer. A chin strap assembly releasably secures the helmet to the wearer and includes a lower flexible strap extending outwardly from each side of a central protective member. When the helmet is worn, an extent of the lower flexible strap is received by the slot when said strap is affixed to the snap connector. The shell also includes a raised central band integrally formed as part of the shell and extending across the crown region to the rear region. An arrangement of elongated vent openings flank the raised central band.

29 Claims, 12 Drawing Sheets

Related U.S. Application Data continuation of application No. 13/838,638, filed on Mar. 15, 2013, now Pat. No. 8,938,818, which is a continuation of application No. 13/153,197, filed on Jun. 3, 2011, now Pat. No. 8,528,118, which is a continuation of application No. 11/653,078, filed on Jan. 10, 2007, now Pat. No. 7,954,177, which is a division of application No. 11/208,233, filed on Aug. 18, 2005, now Pat. No. 7,240,376, which is a continuation of application No. 10/427,236, filed on May 1, 2003, now Pat. No. 6,934,971.

(60) Provisional application No. 60/376,898, filed on May 1, 2002.

(56) References Cited

U.S. PATENT DOCUMENTS 1,080,690 A 12/1913 Hipkiss
1,203,564 A 11/1916 April
1,244,559 A 10/1917 Stocks
1,262,818 A 4/1918 McGill
1,449,183 A 3/1923 Johnstone
1,522,024 A 1/1925 Nixon, Jr.
1,522,952 A 1/1925 Goldsmith
1,559,252 A 10/1925 Hartman
1,602,727 A 10/1926 Turner
1,637,692 A 8/1927 Fitzpatrick
1,655,007 A 1/1928 Boettge
1,660,375 A * 2/1928 Dieterle ..... A42B 3/00 2/423
1,669,914 A * 5/1928 Rogers ..... A42B 3/00 2/421
1,691,202 A 11/1928 La Van
1,705,879 A 3/1929 Rodgers
1,714,275 A 5/1929 Mullins
D80,880 S 4/1930 Dickman
D81,055 S 4/1930 Heater
1,833,708 A 11/1931 Ford
1,839,657 A * 1/1932 Duchek ..... A42B 3/14 2/414
1,841,232 A 1/1932 Wells
1,842,953 A 1/1932 Turner
1,868,926 A 7/1932 Tatore
1,892,943 A 1/1933 Geyer
1,997,187 A 4/1935 Taylor
D100,972 S 8/1936 Pryale
2,081,335 A 5/1937 Levinson
2,105,028 A 1/1938 Dickhoff
2,105,607 A 1/1938 McMillan
2,125,854 A 8/1938 Standley
2,140,716 A 12/1938 Pryale
2,150,290 A 3/1939 Mulvey
2,194,903 A 3/1940 Holstein
D123,638 S 11/1940 Perrin
2,250,275 A 7/1941 Riddell
2,250,375 A 7/1941 Hegan
2,293,308 A 8/1942 Riddell, Sr.
2,296,335 A 9/1942 Brady
2,354,840 A 8/1944 Seletz
2,359,387 A 10/1944 Riddell
2,451,483 A 10/1948 Goldsmith
2,525,389 A 10/1950 Zeller
2,570,182 A 10/1951 Daly
2,634,415 A 4/1953 Turner
D171,297 S 1/1954 D'Arbeloff
2,679,046 A 5/1954 Dye
2,688,747 A 9/1954 Marx
2,758,304 A 8/1956 McGowan
2,768,380 A 10/1956 Golomb
2,777,127 A 1/1957 Marietta
2,785,404 A 3/1957 Strohm
2,785,405 A 3/1957 Snyder
D180,239 S 5/1957 McMurry
2,793,365 A 5/1957 Kleinman
2,850,740 A 9/1958 Adams
2,861,272 A 11/1958 Stuart
2,863,151 A 12/1958 Morgan, Jr.
2,867,811 A 1/1959 Jones
2,890,457 A 6/1959 Marietta
2,904,645 A 9/1959 Sarles
2,944,263 A 7/1960 Rayburn
2,969,546 A 1/1961 Morgan, Jr.
2,985,883 A 5/1961 Marietta
2,986,739 A 6/1961 Rozzi, Sr.
3,039,108 A 6/1962 Lohrenz
3,039,109 A 6/1962 Simpson
3,055,013 A 9/1962 Aleo
3,088,002 A 4/1963 Heisig
3,106,716 A 10/1963 Beebe
3,113,318 A 12/1963 Marietta
3,116,490 A 1/1964 Ted
3,122,752 A 3/1964 Marietta
3,139,624 A 7/1964 Humphrey
3,153,792 A 10/1964 Marietta
3,153,973 A 10/1964 Marietta
3,155,981 A 11/1964 McKissick
3,166,761 A 1/1965 Strohm
3,167,783 A 2/1965 Wolfe
3,174,155 A 3/1965 Pitman
3,186,004 A 6/1965 Carlini
3,187,342 A 6/1965 Aileo
3,189,917 A 6/1965 Sims
3,216,023 A 11/1965 Morgan
3,223,086 A 12/1965 Denton
3,263,236 A 8/1966 Humphrey
3,273,162 A 9/1966 Andrews, III
3,274,612 A 9/1966 Merriam
3,274,613 A 9/1966 Sowle
3,283,336 A 11/1966 Critser
3,292,180 A 12/1966 Marietta
3,296,582 A 1/1967 Ide
3,315,272 A 4/1967 Olt
3,323,134 A 6/1967 Swyers
3,327,313 A 6/1967 Oliver
3,344,433 A 10/1967 Stapenhill
3,364,499 A 1/1968 Kwoka
3,373,443 A 3/1968 Marietta
D212,582 S 11/1968 Feldmann
3,418,657 A 12/1968 Lastnik
D213,085 S 1/1969 Wyckoff
3,447,162 A 6/1969 Aileo
3,447,163 A 6/1969 Bothwell
3,462,763 A 8/1969 Schneider
3,478,365 A 11/1969 Varga
D216,988 S 3/1970 Je Rue
3,500,472 A 3/1970 Castellani
3,500,475 A * 3/1970 Otsuka ..... A42B 3/32 2/421
D217,894 S 6/1970 Mikita
3,548,409 A 12/1970 Aileo
3,548,410 A 12/1970 Parker
3,551,911 A * 1/1971 Holden ..... A42B 3/00 2/411
3,566,409 A 3/1971 Hopper
3,568,210 A 3/1971 Marietta
3,577,562 A 5/1971 Holt
3,582,990 A 6/1971 Frieder
3,590,388 A 7/1971 Holt
3,600,714 A 8/1971 Greathouse
D221,923 S 9/1971 Jones
3,605,113 A 9/1971 Marietta
3,609,764 A 10/1971 Morgan
3,616,463 A 11/1971 Theodore
3,619,813 A 11/1971 Marchello
3,629,864 A 12/1971 Latina
3,713,640 A 1/1973 Margan
3,720,955 A 3/1973 Rawlings
3,729,744 A 5/1973 Rappleyea
3,729,746 A 5/1973 Humphrey
D228,211 S 8/1973 O'Connor
3,751,728 A 8/1973 Thompkins
3,761,959 A 10/1973 Dunning

(56) References Cited

U.S. PATENT DOCUMENTS 3,783,450 A * 1/1974 O'Connor ..... A42B 3/124 2/421
3,787,895 A 1/1974 Belvedere
3,793,241 A 2/1974 Kyle
D230,911 S 3/1974 Ispas
3,815,152 A 6/1974 Bednarczuk
3,818,508 A 6/1974 Lammers
3,820,163 A 6/1974 Rappleyea
3,843,970 A 10/1974 Marietta
3,849,801 A 11/1974 Holt
3,854,146 A 12/1974 Dunning
3,860,966 A 1/1975 Brown
D234,549 S 3/1975 Bell
3,872,511 A 3/1975 Nichols
3,882,547 A 5/1975 Morgan
3,889,296 A 6/1975 Martin
D235,941 S 7/1975 Stock
3,897,597 A 8/1975 Kasper
3,916,446 A 11/1975 Gooding
D237,844 S 12/1975 Stock
3,934,271 A 1/1976 Rhee
3,992,721 A 11/1976 Morton
3,994,020 A 11/1976 Villari
3,994,021 A 11/1976 Villari
3,994,022 A 11/1976 Villari
3,999,220 A 12/1976 Keltner
4,023,209 A 5/1977 Frieder
4,023,213 A 5/1977 Rovani
4,028,743 A 6/1977 Christensen
4,044,400 A 8/1977 Lewicki
4,060,855 A 12/1977 Rappleyea
4,075,714 A 2/1978 Ryder
4,086,664 A 5/1978 Humphrey
4,101,983 A 7/1978 Dera
4,134,155 A 1/1979 Robertson
4,136,403 A 1/1979 Walther
4,168,542 A 9/1979 Small
D254,100 S 2/1980 Breger
D255,394 S 6/1980 McNabb
D256,626 S 9/1980 Antonino
D257,073 S 9/1980 Jenkins
4,223,409 A 9/1980 Lee
4,233,687 A 11/1980 Lancellotti
4,239,106 A 12/1980 Aileo
4,272,853 A 6/1981 Schuessler
4,279,038 A 7/1981 Brueckner
4,282,610 A 8/1981 Steigerwald
4,287,613 A 9/1981 Schulz
4,300,242 A 11/1981 Nava
4,307,471 A 12/1981 Lovell
4,326,303 A 4/1982 Rappleyea
D265,520 S 7/1982 Gooding
4,345,338 A 8/1982 Frieder, Jr.
D266,626 S 10/1982 Gooding
D266,627 S 10/1982 Gooding
4,354,284 A 10/1982 Gooding
D267,287 S 12/1982 Gooding
4,363,140 A 12/1982 Correale
4,370,759 A 2/1983 Zide
4,390,995 A 7/1983 Walck
4,398,306 A 8/1983 Gooding
4,404,690 A 9/1983 Farquharson
D271,249 S 11/1983 Farquharson
D271,347 S 11/1983 Bourque
4,432,099 A 2/1984 Grick
4,434,514 A 3/1984 Sundahl
4,446,576 A * 5/1984 Hisataka ..... A42B 3/24 2/412
4,461,044 A 7/1984 Reiterman
4,463,456 A 8/1984 Hanson
4,466,138 A 8/1984 Gessalin
4,475,248 A 10/1984 Abbe
4,477,929 A * 10/1984 Mattsson ..... A42B 3/324 2/417
4,558,470 A 12/1985 Mitchell
4,566,137 A 1/1986 Gooding
D283,268 S 4/1986 Rebiskie
4,586,200 A 5/1986 Poon
4,587,677 A 5/1986 Clement
D285,980 S 10/1986 McNabb
4,627,115 A 12/1986 Broersma
4,633,531 A 1/1987 Nimmons
4,646,368 A 3/1987 Infusino
4,651,356 A 3/1987 Zide
4,665,569 A 5/1987 Santini
4,667,348 A 5/1987 Sundahl
4,677,694 A 7/1987 Crow
4,692,947 A 9/1987 Black
4,706,305 A 11/1987 Cho
D295,800 S 5/1988 Shelton
D295,902 S 5/1988 Foulkes
4,741,054 A 5/1988 Mattes
4,744,107 A 5/1988 Foehl
4,766,614 A 8/1988 Cantwell
4,766,616 A 8/1988 Donahue
4,774,729 A 10/1988 Coates
D298,367 S 11/1988 Ball
4,794,652 A 1/1989 Piech Von Planta
D299,978 S 2/1989 Chiarella
4,808,469 A 2/1989 Hiles
4,831,668 A 5/1989 Schulz
4,837,866 A 6/1989 Rector
4,853,980 A 8/1989 Zarotti
4,856,119 A 8/1989 Haeberle
4,866,792 A 9/1989 Arai
D303,851 S 10/1989 Gentes
4,885,806 A 12/1989 Heller
4,885,807 A 12/1989 Snow, Jr.
4,903,346 A 2/1990 Reddemann
4,903,348 A 2/1990 Broersma
4,903,350 A 2/1990 Gentes
4,916,759 A 4/1990 Arai
D309,512 S 7/1990 Crow
4,937,888 A 7/1990 Straus
4,947,490 A 8/1990 Hayden
4,996,724 A 3/1991 Dextrase
5,014,365 A 5/1991 Schulz
5,023,958 A 6/1991 Rotzin
5,035,009 A 7/1991 Wingo, Jr.
D319,112 S 8/1991 Broersma
5,044,016 A 9/1991 Coombs
5,083,321 A 1/1992 Davidsson
5,090,061 A 2/1992 Kamata
5,093,936 A 3/1992 Copeland
5,093,937 A 3/1992 Kamata
5,093,939 A 3/1992 Noyerie
5,101,517 A * 4/1992 Douglas ..... A42B 3/20 2/424
5,119,516 A 6/1992 Broersma
5,129,108 A 7/1992 Copeland
5,136,728 A 8/1992 Kamata
5,142,700 A 8/1992 Reed
5,165,116 A 11/1992 Simpson
D331,645 S 12/1992 Gallet
D332,507 S 1/1993 Anderson
5,175,889 A 1/1993 Infusino
5,177,815 A 1/1993 Andujar
5,177,816 A 1/1993 Schmidt
5,203,034 A 4/1993 Foehl
5,231,703 A 8/1993 Garneau
D339,427 S 9/1993 Gentes
5,263,203 A 11/1993 Kraemer
5,263,204 A 11/1993 Butsch
5,267,353 A 12/1993 Milligan
5,271,103 A 12/1993 Darnell
5,272,773 A 12/1993 Kamata
5,287,562 A 2/1994 Rush
5,291,880 A 3/1994 Almovist
5,293,649 A 3/1994 Corpus
5,298,208 A 3/1994 Sibley
D347,300 S 5/1994 Gentes
5,309,576 A 5/1994 Broersma
D348,545 S 7/1994 Egger
D348,752 S 7/1994 Ho

(56) References Cited

U.S. PATENT DOCUMENTS

| | | | |
|---|---|---|---|
| 5,327,588 | A | 7/1994 | Garneau |
| RE34,699 | E | 8/1994 | Copeland |
| D350,710 | S | 9/1994 | Keiffer |
| 5,347,660 | A | 9/1994 | Zide |
| D352,802 | S | 11/1994 | Jeng |
| D352,803 | S | 11/1994 | Sasaki |
| D355,394 | S | 2/1995 | Bezener |
| D357,554 | S | 4/1995 | Garneau |
| D357,555 | S | 4/1995 | Brueckner |
| D358,003 | S | 5/1995 | Losi |
| D358,004 | S | 5/1995 | Losi |
| D358,232 | S | 5/1995 | Bourque |
| D358,905 | S | 5/1995 | Newman |
| 5,412,814 | A | 5/1995 | Pernicka |
| 5,418,257 | A | 5/1995 | Weisman |
| D361,407 | S | 8/1995 | Ho |
| D361,408 | S | 8/1995 | Ho |
| D361,409 | S | 8/1995 | Ho |
| D362,084 | S | 9/1995 | Egger |
| 5,448,780 | A | 9/1995 | Gath |
| 5,450,631 | A | 9/1995 | Egger |
| 5,461,730 | A | 10/1995 | Carrington |
| D364,487 | S | 11/1995 | Tutton |
| 5,475,878 | A | 12/1995 | Dawn |
| 5,483,699 | A | 1/1996 | Pernicka |
| 5,493,736 | A | 2/1996 | Allison |
| 5,502,843 | A | 4/1996 | Strickland |
| 5,515,546 | A | 5/1996 | Shifrin |
| 5,517,691 | A | 5/1996 | Blake |
| 5,518,802 | A | 5/1996 | Colvin |
| 5,522,091 | A | 6/1996 | Rudolf |
| D371,867 | S | 7/1996 | Losi, II |
| D371,868 | S | 7/1996 | Losi |
| D371,869 | S | 7/1996 | Chen |
| D372,342 | S | 7/1996 | Chen |
| 5,539,936 | A | 7/1996 | Thomas |
| 5,544,367 | A | 8/1996 | March, II |
| 5,553,330 | A | 9/1996 | Carveth |
| 5,561,866 | A | 10/1996 | Ross |
| D378,236 | S | 2/1997 | Zanotto |
| D378,624 | S | 3/1997 | Chartrand |
| D380,870 | S | 7/1997 | Szabados |
| D382,671 | S | 8/1997 | Shewchenko |
| 5,655,227 | A | 8/1997 | Sundberg |
| D383,953 | S | 9/1997 | DeFilippo |
| 5,661,854 | A | 9/1997 | March, II |
| 5,675,875 | A | 10/1997 | Servatius |
| D387,501 | S | 12/1997 | Cheng |
| D388,551 | S | 12/1997 | Lu |
| D389,280 | S | 1/1998 | Ho |
| 5,708,988 | A | 1/1998 | McGuine |
| 5,713,082 | A | 2/1998 | Bassette |
| 5,724,681 | A | 3/1998 | Sykes |
| 5,732,414 | A | 3/1998 | Monica |
| 5,734,994 | A | 4/1998 | Rogers |
| 5,737,770 | A | 4/1998 | Chen |
| 5,787,513 | A | 8/1998 | Sharmat |
| 5,790,988 | A | 8/1998 | Guadagnino, Jr. |
| 5,794,271 | A | 8/1998 | Hastings |
| 5,794,274 | A | 8/1998 | Kraemer |
| 5,799,337 | A | 9/1998 | Brown |
| 5,829,065 | A | 11/1998 | Cahill |
| 5,867,840 | A | 2/1999 | Hirosawa |
| D406,399 | S | 3/1999 | Hohdorf |
| 5,883,145 | A | 3/1999 | Hurley |
| D408,236 | S | 4/1999 | Rennick |
| 5,913,412 | A | 6/1999 | Huber |
| 5,915,537 | A | 6/1999 | Dallas |
| D412,376 | S | 7/1999 | Jurga |
| D412,766 | S | 8/1999 | Tang |
| 5,930,840 | A | 8/1999 | Arai |
| 5,938,878 | A | 8/1999 | Hurley |
| 5,940,890 | A | 8/1999 | Dallas |
| 5,943,706 | A | 8/1999 | Miyajima |
| 5,946,735 | A | 9/1999 | Bayes |
| 5,950,243 | A | 9/1999 | Winters |
| 5,950,244 | A | 9/1999 | Fournier |
| 5,953,761 | A | 9/1999 | Jurga |
| 5,956,777 | A | 9/1999 | Popovich |
| D415,593 | S | 10/1999 | Tang |
| 5,963,990 | A | 10/1999 | White |
| 5,966,744 | A | 10/1999 | Smith, Jr. |
| 5,978,973 | A | 11/1999 | Chartrand |
| 5,991,930 | A | 11/1999 | Sorrentino |
| 6,047,400 | A | 4/2000 | Spencer |
| D426,677 | S | 6/2000 | Ho |
| 6,070,271 | A | 6/2000 | Williams |
| 6,073,271 | A | 6/2000 | Alexander |
| 6,079,053 | A | 6/2000 | Clover, Jr. |
| 6,081,932 | A | 7/2000 | Kraemer |
| 6,088,840 | A | 7/2000 | Im |
| 6,128,786 | A | 10/2000 | Maddux |
| 6,131,196 | A | 10/2000 | Vallion |
| 6,138,283 | A | 10/2000 | Kress |
| 6,138,284 | A | 10/2000 | Arai |
| 6,154,889 | A | 12/2000 | Moore, III |
| 6,159,324 | A | 12/2000 | Watters |
| 6,178,560 | B1 | 1/2001 | Halstead |
| 6,189,156 | B1 | 2/2001 | Loiars |
| 6,199,219 | B1 | 3/2001 | Silken |
| 6,219,850 | B1 | 4/2001 | Halstead |
| 6,226,801 | B1 | 5/2001 | Alexander |
| D444,268 | S | 6/2001 | Montello |
| 6,240,571 | B1 | 6/2001 | Infusino |
| D445,218 | S | 7/2001 | Watters |
| D445,962 | S | 7/2001 | Brignone |
| 6,256,798 | B1 | 7/2001 | Egolf |
| 6,266,827 | B1 | 7/2001 | Lampe |
| 6,272,692 | B1 | 8/2001 | Abraham |
| D447,604 | S | 9/2001 | Watters |
| D448,526 | S | 9/2001 | Brignone |
| 6,282,724 | B1 | 9/2001 | Abraham |
| 6,282,726 | B1 | 9/2001 | Noyerie |
| 6,292,952 | B1 | 9/2001 | Watters |
| D448,890 | S | 10/2001 | Brignone |
| 6,298,483 | B1 | 10/2001 | Schiebl |
| 6,298,497 | B1 | 10/2001 | Chartrand |
| 6,301,719 | B1 | 10/2001 | Goodhand |
| 6,314,586 | B1 | 11/2001 | Duguid |
| 6,321,386 | B1 | 11/2001 | Monica |
| 6,324,701 | B1 | 12/2001 | Alexander |
| 6,332,228 | B1 | 12/2001 | Takahara |
| 6,339,849 | B1 | 1/2002 | Nelson |
| D453,399 | S | 2/2002 | Racine |
| 6,351,853 | B1 | 3/2002 | Halstead |
| 6,360,376 | B1 | 3/2002 | Carrington |
| 6,370,699 | B1 | 4/2002 | Halstead |
| 6,378,140 | B1 | 4/2002 | Abraham |
| 6,385,780 | B1 | 5/2002 | Racine |
| 6,389,607 | B1 | 5/2002 | Wood |
| D459,032 | S | 6/2002 | Gatellet |
| D459,554 | S | 6/2002 | Gatellet |
| D459,555 | S | 6/2002 | Gatellet |
| 6,421,841 | B2 | 7/2002 | Ikeda |
| 6,434,755 | B1 | 8/2002 | Halstead |
| 6,438,762 | B1 | 8/2002 | Jenkins |
| 6,438,763 | B2 | 8/2002 | Guay |
| 6,442,765 | B1 | 9/2002 | Fallon |
| 6,446,270 | B1 | 9/2002 | Durr |
| D465,067 | S | 10/2002 | Infusino |
| 6,467,099 | B2 | 10/2002 | Dennis |
| 6,481,024 | B1 | 11/2002 | Grant |
| D466,651 | S | 12/2002 | Halstead |
| 6,499,139 | B1 | 12/2002 | Brown |
| 6,499,147 | B2 | 12/2002 | Schiebl |
| 6,532,602 | B2 | 3/2003 | Watters |
| D475,486 | S | 6/2003 | Ide |
| 6,604,246 | B1 | 8/2003 | Obreja |
| 6,658,671 | B1 | 12/2003 | Von Holst |
| 6,701,535 | B2 | 3/2004 | Dobbie |
| D492,818 | S | 7/2004 | Ide |
| 6,772,447 | B2 * | 8/2004 | Morrow ..... A42B 3/08 2/414 |
| 6,826,509 | B2 | 11/2004 | Crisco, III |

(56) References Cited

U.S. PATENT DOCUMENTS

| | | | |
|---|---|---|---|
| 6,880,176 | B2 | 4/2005 | Timms |
| 6,934,971 | B2 | 8/2005 | Ide |
| 6,961,963 | B2 | 11/2005 | Rosie |
| 7,036,151 | B2 | 5/2006 | Ide |
| D528,705 | S | 9/2006 | Ide |
| 7,146,652 | B2 | 12/2006 | Ide |
| 7,240,376 | B2 | 7/2007 | Ide |
| D581,099 | S | 11/2008 | Ahn |
| 7,954,177 | B2 | 6/2011 | Ide |
| 8,528,118 | B2 | 9/2013 | Ide |
| 8,938,818 | B2 | 1/2015 | Ide |
| D747,040 | S | 1/2016 | Milam |
| D753,346 | S | 4/2016 | Warmouth |
| D836,253 | S | 12/2018 | Erb |
| 10,149,511 | B2 | 12/2018 | Vito |
| 2001/0032351 | A1 | 10/2001 | Nakayama |
| 2001/0039674 | A1 | 11/2001 | Shida |
| 2002/0104533 | A1 | 8/2002 | Kalhok |
| 2002/0174480 | A1 | 11/2002 | Lombard |
| 2003/0056279 | A1 | 3/2003 | Garneau |
| 2003/0188375 | A1 | 10/2003 | Wilson |
| 2003/0209241 | A1 | 11/2003 | Fournier |
| 2004/0025231 | A1 | 2/2004 | Ide |
| 2004/0181854 | A1 | 9/2004 | Primrose |
| 2005/0114975 | A1 | 6/2005 | Kraemer |
| 2005/0235403 | A1 | 10/2005 | Kraemer |
| 2005/0278835 | A1 | 12/2005 | Ide |
| 2007/0192944 | A1 | 8/2007 | Kraemer |
| 2008/0092277 | A1 | 4/2008 | Kraemer |
| 2011/0277221 | A1 | 11/2011 | Withnall |
| 2014/0007327 | A1 | 1/2014 | Infusino |
| 2014/0150169 | A1 | 6/2014 | Infusino |
| 2015/0135414 | A1 | 5/2015 | Infusino |

FOREIGN PATENT DOCUMENTS

| | | |
|---|---|---|
| CN | 2870519 | 2/2007 |
| CN | 2896943 | 5/2007 |
| DE | 8321097 U1 | 10/1983 |
| DE | 3222681 | 12/1983 |
| DE | 3338188 | 5/1985 |
| DE | 3603234 | 8/1987 |
| DE | 3632525 | 8/1996 |
| DE | 19745960 | 10/1997 |
| EP | 0512193 | 11/1992 |
| EP | 1199000 | 4/2002 |
| EP | 1972220 | 9/2008 |
| GB | 256430 | 8/1926 |
| GB | 1354719 | 6/1974 |
| JP | S57205511 | 12/1982 |
| JP | H05132809 | 5/1993 |
| JP | H07109609 | 4/1995 |
| JP | H07126908 | 5/1995 |
| JP | H1077521 | 3/1998 |
| JP | H10195707 | 7/1998 |
| JP | H11189910 | 7/1999 |
| JP | 2000265315 | 9/2000 |
| JP | 2001003220 | 1/2001 |
| JP | 2001020121 | 1/2001 |
| JP | 2002161426 | 6/2002 |
| WO | 9534229 | 12/1995 |
| WO | 9911152 | 3/1999 |
| WO | 9956572 | 11/1999 |
| WO | 0152676 | 7/2001 |
| WO | 2007013106 | 2/2007 |

OTHER PUBLICATIONS

Riddell 1991 Catalog (11 pages).
Riddell 1992 Catalog (40 pages).
Riddell 1993 Football Catalog (32 pages).
Riddell 1993 Product Catalog (12 pages).
Riddell 1994 Football Catalog (20 pages).
Riddell 1995 Factory Direct Savings Catalog (22 pages).
Riddell 1996-1997 Baseball and Softball Catalog (24 pages).
Riddell 1996-1997 Football Catalog (40 pages).
Riddell 1997-1998 Football Catalog (55 pages).
Riddell 1998 Football Air Catalog (16 pages).
Riddell 1998-1999 Football Catalog (72 pages).
Riddell 2000 Baseball Catalog (52 pages).
Riddell 2000 Football Catalog (76 pages).
Riddell 2001 Baseball Catalog (79 pages).
Riddell 2001 Football Catalog (94 pages).
Riddell Bio Lite Helmet, 1988 (3 pages).
Riddell Inc., Screenshots of http://www.riddell.com/history, captured Feb. 20, 2014.
Riddell Inc.'s Responsive Expert Report of Mr. Shewchenko; *Riddell Inc.* v. *Kranos Corp.*, N.D. IL, case 1:16-cv-04496 (142 pages).
Riddell Institutional Football Catalog (33 pages).
Riddell Opposition to Schutt's Motion for Partial Summary Judgment of U.S. Pat. No. 8,939,818, Case 1:16-cv-04496 (21 pages).
Riddell Team Tested Tuff Catalog (31 pages).
Riddell's Response to Schutt's Local Rule 56.1 Statement of Material Facts in Support of Schutt's Motion for Partial Summary Judgment and Riddell's Statement of Additional Facts that Require Denial of Summary Judgment of U.S. Pat. No. 8,938,818, Case 1:16-cv-04496 (52 pages).
Riddell's Response to Schutt's Opening Claim Construction Brief, Case 1:16-cv-04496 (33 pages).
Riddell's Response to Xenith's Opening Claim Construction Brief, Case 1:16-cv-04496 (31 pages).
Riddell's Responses and Objections to Schutt's First Set of Interrogatories (17 pages).
Riddell's Third Supplemental Responses and Objections to Schutt's First Set of Interrogatories (27 pages).
Robert Smith, Illustrated History of Pro Football (1970), cover illustration.
Scholastic Coach, MacGregor E700 Helmet, Jan. 1959 (2 pages).
Scholastic Coach, Spalding Helmet, Mar. 1959 (2 pages).
Scholastic Coach, Spalding No. 100, Dec. 1950 (2 pages).
Schutt 2001 Football Catalog (46 pages).
Schutt's Final Invalidity Contentions Exhibit A '818 Patent, Case 1:16-cv-04496 (904 pages).
Schutt's Final Invalidity Contentions Exhibit AB1—Alternate Combos Under 103—Ear Openings, Case 1:16-cv-04496 (29 pages).
Schutt's Final Invalidity Contentions Exhibit AB2—Alternate Combos Under 103—Raised Central Band, Case 1:16-cv-04496 (58 pages).
Schutt's Final Invalidity Contentions Exhibit AB3—Alternate Combos Under 103—Vent Openings, Case 1:16-cv-04496, (47 pages).
Schutt's Final Invalidity Contentions Exhibit AB4—Alternate Combos Under 103—Chin Strap, Case 1:16-cv-04496 (31 pages).
Schutt's Final Invalidity Contentions Exhibit AB5—Alternate Combos Under 103—Face Guard, Case 1:16-cv-04496 (32 pages).
Schutt's Final Invalidity Contentions Exhibit AB6—Alternate Combos Under 103—Offset Band, Case 1:16-cv-04496 (11 pages).
Schutt's Final Invalidity Contentions Exhibit AB7—Alternate Combos Under 103—Inflation, Case 1:16-cv-04496 (21 pages).
Schutt's Final Invalidity Contentions Exhibit B '118 Patent, Case 1:16-cv-04496 (415 pages).
Schutt's Final Invalidity Contentions, Case 1:16-cv-04496 (104 pages).
Schutt's Motion for Partial Summary Judgment of U.S. Pat. No. 8,938,818, Case 1:16-cv-04496 (22 pages).
Schutt's Opening Claim Construction Brief, Case 1:16-cv-04496 (51 pages).
Schutt's Reply Claim Construction Brief, Case 1:16-cv-04496 (18 pages).
Schutt's Reply in Support of its Motion for Partial Summary Judgment of U.S. Pat. No. 8,938,818, Case 1:16-cv-04496 (22 pages).
Schutt's Response to Riddell's Local Rule 56.1 Statement of Material Facts in Opposition to Schutt's Motion for Partial Summary Judgment of U.S. Pat. No. 8,938,818, Case 1:16-cv-04496 (19 pages).
Screenshots from 1997 Starship Troopers Movie (12 pages).

(56) References Cited

OTHER PUBLICATIONS

Sears Catalog, Cycolac Plastic Helmet (2 pages).
Sears Fall and Winter 1968 Catalog T-Bar Helmet (4 pages).
Sears Fall and Winter Catalog 1963 (2 pages).
Sears Fall and Winter Catalog 1966 (2 pages).
Sears Wish Book for the 1971 Christmas Season Catalog (11 pages).
Second Supplemental Declaration of Thad M. Ide (with Exhibits A-N), Dated Apr. 28, 2016, Inter Partes Reexamination Control No. 95/002,117 (68 pages).
Shoei Catalog 1999 (16 pages).
Sports Review Football 1954, Rawlings HC20 and TH24 Helmet (2 page).
Stall & Dean Fall and Winter Catalog 1960-1961 (72 pages).
Supplemental Declaration of Thad M. Ide (with Exhibits A-D), Dated Jan. 21, 2014, Inter Partes Reexamination Control No. 95/002,117 (16 pages).
The Draper Maynard Co., D&M Sporting Goods Catalog, 1925-1926.
Wilson Sporting Goods Company Fall and Winter 1972 Catalog (88 pages).
Wilson Sporting Goods Company Fall and Winter 1976 Catalog (28 pages).
Wilson Trade Price Edition 1952-1953 Football Catalog (100 pages).
Wilson Trade Price Edition 1953 Football Catalog (56 pages).
Wilson Trade Price Edition Fall and Winter 1964 Catalog (152 pages).
Xenith's Final Invalidity Contentions, Case 1:16-cv-04496 (31 pages).
Xenith's Invalidity Contentions Exhibits C1-C11 818 chart, Case 1:16-cv-04496 (341 pages).
Xenith's Invalidity Contentions Exhibits D1-D11 118 chart, Case 1:16-cv-04496 (457 pages).
Xenith's Opening Claim Construction Brief, Case 1:16-cv-04496 (35 pages).
Xenith's Reply Claim Construction Brief, Case 1:16-cv-04496 (16 pages).
Riddell 2002 Football Catalog (88 pages).
Athletic Journal Catalog Excerpt, vol. 34, No. 7, Mar. 1954 (2 pages).
Athletic Journal Catalog Excerpt, vol. 35, No. 10, Jun. 1956 (2 pages).
Athletic Journal Catalog Excerpt, vol. 35, No. 9, May 1955 (2 pages).
Athletic Journal Catalog Excerpt, vol. 35, No. 6, Feb. 1955 (2 pages).
Athletic Journal Catalog Excerpt, vol. 36, No. 3, Nov. 1955 (2 pages).
Athletic Journal Catalog Excerpt, vol. 36, No. 5, Jan. 1956 (2 pages).
Athletic Journal Catalog Excerpt, vol. 36, No. 6, Feb. 1956 (2 pages).
Athletic Journal Catalog Excerpt, vol. 36, No. 7, Mar. 1956 (2 pages).
Athletic Journal Catalog Excerpt, vol. 36, No. 8, Apr. 1956 (2 pages).
Athletic Journal Catalog Excerpt, vol. 37, No. 2, Oct. 1956 (2 pages).
Athletic Journal Catalog Excerpt, vol. 37, No. 4, Dec. 1956 (2 pages).
Athletic Journal Catalog Excerpt, vol. 37, No. 5, Jan. 1957 (2 pages).
Athletic Journal Catalog Excerpt, vol. 37, No. 6, Feb. 1957 (2 pages).
Athletic Journal Catalog Excerpt, vol. 37, No. 7, Mar. 1957 (2 pages).
Athletic Journal Catalog Excerpt, vol. 37, No. 9, May 1957 (2 pages).
Athletic Journal Catalog Excerpt, vol. 38, No. 10, Jun. 1959 (2 pages).
Athletic Journal Catalog Excerpt, vol. 38, No. 6, Feb. 1958 (2 pages).
Athletic Journal Catalog Excerpt, vol. 40, No. 10, Jun. 1960 (2 pages).
Athletic Journal Catalog Excerpt, vol. 40, No. 4, Dec. 1959 (2 pages).
Athletic Journal Catalog Excerpt, vol. 40, No. 9, May 1960 (2 pages).
Athletic Journal Catalog Excerpt, vol. 41, No. 10, Jun. 1961 (2 pages).
Athletic Journal Catalog Excerpt, vol. 41, No. 9, May 1961 (2 pages).
Athletic Journal Catalog Excerpt, vol. 43, No. 5, Jan. 1963 (2 pages).
Athletic Journal Catalog Excerpt, vol. 43, No. 8, Apr. 1963 (2 pages).
Athletic Journal Catalog Excerpt, vol. 44, No. 10, Jun. 1964 (2 pages).
Athletic Journal Catalog Excerpt, vol. 44, No. 2, Oct. 1964 (2 pages).
Athletic Journal Catalog Excerpt, vol. 44, No. 9, May 1964 (2 pages).
Athletic Journal Catalog Excerpt, vol. 45, No. 10, Jun. 1965 (3 pages).
Athletic Journal Catalog Excerpt, vol. 45, No. 9, May 1965 (2 pages).
Athletic Journal Catalog Excerpt, vol. 46, No. 10, Jun. 1966 (2 pages).
Athletic Journal Catalog Excerpt, vol. 46, No. 3, Nov. 1965 (2 pages).
Athletic Journal Catalog Excerpt, vol. 47, No. 3, Nov. 1966 (2 pages).
Athletic Journal Catalog Excerpt, vol. 48, No. 3, Nov. 1967 (2 pages).
Athletic Journal Catalog Excerpt, vol. 48, No. 5, Jan. 1968 (2 pages).
Athletic Journal Catalog Excerpt, vol. 48, vol. 10, Jun. 1968 (2 pages).
Athletic Journal Catalog Excerpt, vol. 49, No. 10, Jun. 1969 (2 pages).
Athletic Journal Catalog Excerpt, vol. 49, No. 8, Apr. 1969 (2 pages).
Athletic Journal Catalog Excerpt, vol. 50, No. 8, Apr. 1970 (2 pages).
Athletic Journal Catalog Excerpt, vol. 51, No. 6, Feb. 1971 (2 pages).
Athletic Journal Catalog Excerpt, vol. 53, No. 8, Apr. 1973 (2 pages).
Athletic Journal Catalog Excerpt, vol. 55, No. 3, Nov. 1974 (2 pages).
Athletic Journal Catalog Excerpt, vol. 56, No. 5, Jan. 1976 (6 pages).
Athletic Journal Catalog Excerpt, vol. 57, No. 4, Dec. 1976 (2 pages).
Athletic Journal Catalog Excerpt, vol. 57, No. 5, Jan. 1977 (6 pages).
Athletic Journal Catalog Excerpt, vol. 59, No. 6, Feb. 1979 (3 pages).
Athletic Journal Catalog Excerpt, vol. 60, No. 8, Apr. 1980 (2 pages).
Athletic Journal Catalog Excerpt, vol. 61, No. 4, Dec. 1980 (2 pages).
Athletic Journal Catalog Excerpt, vol. 65, No. 7, Mar. 1985 (2 pages).
Bike Football Catalog 2002 (6 pages).
Claim Construction Order, Case 1:16-cv-04496 (39 pages).
David Bushing, Sports Equipment Price Guide (1995), pp. 236-238, 240-241, 243-244, 263.
Decision Denying Petitioner's Request for Rehearing regarding Non-Instituted Claims of U.S. Pat. No. 8,528,118, Case No. IPR2016-01646 (17 pages).
Decision to Institute Inter Partes Review of Certain Claims of U.S. Pat. No. 8,938,818, Case No. IPR2016-01650 (36 pages).

(56) References Cited

OTHER PUBLICATIONS

Decision with New Ground of Rejection: Examiner Reversed, issued Mar. 29, 2016 in U.S. Appl. No. 95/002,117 (21 pages).
Decision, Institution of Inter Partes Review 37 C.F.R. § 42.108, Entered Feb. 14, 2017, Case No. IPR2016-01646, U.S. Pat. No. 8,528,118 (72 pages).
Decision, Institution of Inter Partes Review 37 C.F.R. § 42.108, Entered Feb. 22, 2017, Case No. IPR2016-01650, U.S. Pat. No. 8,938,818 (36 pages).
Declaration of Allison Boersma Under 37 CFR § 1.132 in Control No. 95/002,117.
Declaration of Dr. James Newman under 37 CFR 1.132 in Control No. 95/002,117.
Declaration of Kyle C. Borland (with Exhibits A-G), Dated Apr. 28, 2016, Inter Partes Reexamination Control No. 95/002,117 (57 pages).
Declaration of Larry Maddux, Dated Feb. 19, 2014, Inter Partes Reexamination Control No. 95/002,117 (6 pages).
Declaration of Nelson Kraemer (with Exhibits A-J), Dated Apr. 29, 2016, Inter Partes Reexamination Control No. 95/002,117 (37 pages).
Declaration of Nicholas Shewchenko in Support of Riddell Opposition to Schutt's Motion for Partial Summary Judgment of U.S. Pat. No. 8,939,818, Case 1:16-cv-04496 (18 pages).
Declaration of Patent Owner's Expert, Nicholas Shewchenko, Case Nos. IPR2016-01649 (U.S. Pat. No. 8,813,269), IPR2016-01646 (U.S. Pat. No. 8,528,118), and IPR2016-1650 (U.S. Pat. No. 8,938,818) (52 pages).
Declaration of Petitioner's Expert, Bernard Daoust, U.S. Pat. No. 8,528,118, Case No. IPR2016-01316 (42 pages).
Declaration of Petitioner's Expert, Bernard Daoust, U.S. Pat. No. 8,938,818 (48 pages).
Declaration of Petitioner's Expert, Jamison Float, U.S. Pat. No. 8,528,118, Case No. IPR2016-01646 (28 pages).
Declaration of Petitioner's Expert, Jamison Float, U.S. Pat. No. 8,938,818, Case No. IPR2016-01530 (47 pages).
Declaration of Petitioner's Expert, Jamison Float, U.S. Pat. No. 8,938,818, Case No. IPR2016-01650 (45 pages).
Declaration of Thad M. Ide Under 37 CFR § 1.131 (with Exhibits A-G) in Control No. 95/002,117.
Declaration of Wayne Lawrence (with Exhibits A-G), Dated Apr. 28, 2016, Inter Partes Reexamination Control No. 95/002,117 (36 pages).
Definition of "aligned" found at the American Heritage dictionary, third edition, copyright 1996, Case No. IPR2016-01530 (4 page).
Deposition of Patent Owner's Expert, Nicholas Shewchenko, Case Nos. IPR2011649 (U.S. Pat. No. 8,813,269), IPR2016-01646 (U.S. Pat. No. 8,528,118), and IPR2016-1650 (U.S. Pat. No. 8,938,818) (192 pages).
Deposition of Petitioner's Expert, Jamison Float, Case Nos. IPR2016-01649 (U.S. Pat. No. 8,813,269), IPR2016-01646 (U.S. Pat. No. 8,528,118), and IPR2016-1650 (U.S. Pat. No. 8,938,818) (99 pages).
Easton Bell Sports, Riddell Fact Sheet. www.eastonbellsports.com/riddell-fact-sheet, 3 pages.
Examiner's Determination regarding New Ground of Rejection, Dated Oct. 24, 2016, Inter Partes Reexamination Control No. 95/002,117 (10 pages).
Face-Off Lacrosse Yearbook 2003, Spring 2003, vol. 10 (3 pages).
Final Written Decision, 35 U.S.C. § 318(a) and 37 C.F.R. § 42.73, *Kranos Corporation* v. *Riddell, Inc*., Entered Feb. 21, 2018, Case No. IPR2016-01650, U.S. Pat. No. 8,938,818 B2 (47 pages).
Final Written Decision, 35 U.S.C. § 318(a) and 37 C.F.R. § 42.73, *Kranos Corporation* v. *Riddell, Inc*., Entered Feb. 5, 2018, Case No. IPR2016-01646, U.S. Pat. No. 8,528,118 C1 (84 pages).
Four Photographs of Riddell, Inc.'s VSR4 football helmet which was commercially available prior to May 1, 2001.
GB Lax Gait Brothers Lacrosse Magazine 2002 (24 pages).
Great Atlantic C Lacrosse Company, Feb. 2000 (1 page).
Hutch Catalog 1976 (40 pages).
Invalidity Chart of U.S. Pat. No. 8,938,818 in Light of Revolution Speed Fitting Guide, Published 2010, Case No. IPR2016-01650 (47 pages).
Invalidity Chart of U.S. Pat. No. 8,938,818 in Light of the Wish Book for the 1971 Christmas Season Catalog, et al., Case No. IPR2016-01650 (66 pages).
Invalidity Chart of U.S. Pat. No. 8,938,818 in Light of U.S. Pat. No. 3,729,744 to Rappleyea et al., Case No. IPR2016-01650 (57 pages).
Invalidity Chart of U.S. Pat. No. 8,938,818 in Light of U.S. Pat. No. 5,732,414 to Monica, et al., Case No. IPR2016-01650 (34 pages).
Invalidity Chart of U.S. Pat. No. 8,938,818 in Light of U.S. Pat. No. 6,219,850 to Halstead, et al., Case No. IPR2016-10530 (37 pages).
Invalidity Chart of U.S. Pat. No. 8,938,818 in Light of U.S. Pat. No. D. 511,026 to Ide, et al., Case No. IPR2016-01530 (47 pages).
Invalidity Chart of U.S. Pat. No. 8,938,818 in Light of U.S. Publication No. 2011/0271428 to Withnall, et al., Case No. IPR2016-01530 (53 pages).
J.A. Dubow Sporting Goods Corp., The Choice of Champions Serving the Sporting Goods Industry for Over 4 Decades 1912-1961 (32 pages).
John Field, Patton of the Armored Force, Life Magazine, Nov. 30, 1942.
Joint Claim Construction Chart, Case 1:16-cv-04496 (9 pages).
King-O'shea Turret Tenite Helmet 1954 (1 page).
Kranos Corp. d/b/a Schutt Sports' Expert Report of Dr. Posner (including Exhibits C-R); *Riddell Inc*. v. *Kranos Corp*., N.D. IL, case 1:16-cv-04496 (686 pages).
Kranos Corp.'s random collection of select catalog images, undated, (76 pages).
Kranos Exhibit 1015 filed in Petition for Inter Partes Review of U.S. Pat. No. 8,938,818 filed Aug. 19, 2016 (4 pages).
Local Rule 56.1 Statement of Material Facts in Support of Schutt's Motion for Partial Summary Judgment of U.S. Pat. No. 8,938,818, Case 1:16-cv-04496 (27 pages).
MacGregor Sports Equipment Fall and Winter 1959 (84 pages).
Marvel Comics, Magneto Revolution (2000), cover illustration.
Medalist Gladiator 1989 Fall and Winter Catalog (20 pages).
Micky Collins et al., Examining Concussion Rates and Return to Play in High School Football Players Wearing Newer Helmet Technology, 58 Neurosurgery 275 (2006).
Midco Fall and Winter, H-400M Helmet, 1975 (8 pages).
Order Denying Defendant's Motion for Partial Summary Judgment of U.S. Pat. No. 8,938,818, Case 1:16-cv-04496 (12 pages).
Patent Owner's Preliminary Response, Case No. IPR2016-01646, U.S. Pat. No. 8,528,118 (66 pages).
Patent Owner's Preliminary Response, Case No. IPR2016-01650, U.S. Pat. No. 8,938,818 (71 pages).
Patent Owner's Preliminary Response, U.S. Pat. No. 8,938,818, Case No. IPR2016-01530 (77 pages).
Patent Owner's Response to the Decision to Institute Inter Partes Review of Certain Claims of U.S. Pat. No. 8,938,818, Case No. IPR2016-01650 (50 pages).
Patent Trial and Appeal Board's Decision regarding Examiner's Determination on New Ground of Rejection, Dated Jun. 22, 2917, Inter Partes Reexamination Control No. 95/002,117 (24 pages).
Patent Trial and Appeal Board's Order Remanding Inter Partes Reexamination to the Examiner, Dated Aug. 23, 2016, Inter Partes Reexamination Control No. 95/002,117 (4 pages).
Petition for Inter Partes Review of U.S. Pat. No. 8,528,118 filed Aug. 19, 2016 (76 pages).
Petition for Inter Partes Review of U.S. Pat. No. 8,938,818 filed Aug. 19, 2016 (142 pages).
Petition for Inter Partes Review of U.S. Pat. No. 8,938,818, Case No. IPR2016-01317 (80 pages).
Petition for Inter Partes Review of U.S. Pat. No. 8,938,818, Case No. IPR2016-01530 (116 pages).
Petitioner's Reply Brief in Support of Its Petition for Inter Partes Review of U.S. Pat. No. 8,938,818, Case No. IPR2016-01650 (29 pages).
Photographs of four (4) helmets bearing labels B1-B5, C1-7, D1-D5, G1-G5, 13 pages, commercially available before Apr. 29, 2003.

(56) References Cited

OTHER PUBLICATIONS

Photographs of three (3) helmets bearing labels A1-A6, E1-E5, and F1-F5, 9 pages, commercially available before May 1, 2001.
Rawlings 1955-56 Advance Football and Basketball Catalog (36 pages).
Rawlings Advance Football and Basketball Catalog 1957 (46 pages).
Rawlings Catalog Fall and Winter Athletic Equipment 1948-1949 (2 pages).
Rawlings Catalog Fall and Winter Athletic Equipment 1949-1950 (74 pages).
Rawlings Catalog Fall and Winter Athletic Equipment 1955-1956 (83 pages).
Rawlings Catalog Fall and Winter Athletic Equipment 1957-1958 (82 pages).
Rawlings Catalog Fall and Winter Athletic Equipment 1959-1960 (84 pages).
Rawlings Catalog Fall and Winter Athletic Equipment 1963 (72 pages).
Rawlings Catalog Fall and Winter Athletic Equipment 1964 (76 pages).
Rawlings Catalog Fall and Winter Equipment and Clothing 1981 (68 pages).
Rawlings Catalog Fall and Winter Institutional 1971 (92 pages).
Rawlings Catalog Fall and Winter Retail Sher-wood Adirondack 1975 (28 pages).
Rebuttal Brief of Appellant Kranos IP Corp., Inter Partes Reexamination Control No. 95/002,117 (10 pages).
Replacement Comments by Third-party Requester Pursuant to 35 U.S.C. § 314(b)(2) and 37 C.F.R. § 1.947 in Control No. 95/002,117.
Riddell 1967 Football Equipment Catalog (16 pages).
Riddell 1969 Equipment Catalog (14 pages).
Riddell 1970 Equipment Catalog (18 pages).
Riddell 1972 Equipment Catalog (14 pages).
Riddell 1973 Equipment Catalog (11 pages).
Riddell 1974 Equipment Catalog (18 pages).
Riddell 1975 Equipment Catalog (19 pages).
Riddell 1976 Equipment Catalog (20 pages).
Riddell 1977 Equipment Catalog (24 pages).
Riddell 1978 Equipment Catalog (24 pages).
Riddell 1979 Equipment Catalog (23 pages).
Riddell 1980 Equipment Catalog (16 pages).
Riddell 1983 Equipment Catalog (34 pages).
Riddell 1984 Equipment Catalog (29 pages).
Riddell 1985 Equipment Catalog (32 pages).
Riddell 1986 Equipment Catalog (24 pages).
Riddell 1987 Equipment Catalog (24 pages).
Riddell 1988 Equipment Catalog (24 pages).
Riddell 1989 Football Air Catalog (16 pages).
Riddell 1989 Football Catalog (24 pages).
Appeal Brief of Appellant Kranos IP Corp, dated Sep. 26, 2014, Inter Partes Reexamination Control No. 95/002,117 (31 pages).
Comments by Kranos I.P. Corp. in Response to Office Action dated Nov. 21, 2013, Inter Partes Reexamination Control No. 95/002,117 (31 pages).
Decision Granting Joint Motion to Terminate Proceeding, U.S. Pat. No. 8,528,118, Case No. IPR2016-01316 (4 pages).
Decision Granting Joint Motion to Terminate Proceeding, U.S. Pat. No. 8,938,818, Case No. IPR2016-01317 (4 pages).
Declaration of Donald John Maclean, dated Jan. 17, 2014, Inter Partes Reexamination Control No. 95/002,117 (4 pages).
Examiner's Right to Appeal Notice, dated Jul. 21, 2014, Inter Partes Reexamination Control No. 95/002,117 (41 pages).
Invalidity Chart of U.S. Pat. No. 8,528,118 in Light of the Wish Book for the 1971 Christmas Season Catalog, et al., Case No. IPR2016-01316 (32 pages).
Invalidity Chart of U.S. Pat. No. 8,528,118 in Light of the Wish Book for the 1971 Christmas Season Catalog, et al., Case No. IPR2016-01646 (24 pages).
Invalidity Chart of U.S. Pat. No. 8,528,118 in Light of U.S. Pat. No. 2,525,389 to Zeller, Case No. IPR2016-01646 (13 pages).
Invalidity Chart of U.S. Pat. No. 8,528,118 in Light of U.S. Pat. No. 3,729,744 to Rappleyea et al., Case No. IPR2016-01316 (21 pages).
Invalidity Chart of U.S. Pat. No. 8,528,118 in Light of U.S. Pat. No. 3,729,744 to Rappleyea, et al., Case No. IPR2016-01646 (26 pages).
Invalidity Chart of U.S. Pat. No. 8,528,118 in Light of U.S. Pat. No. 5,732,414 to Monica, et al., Case No. IPR2016-01316 (23 pages).
Invalidity Chart of U.S. Pat. No. 8,528,118 in Light of U.S. Pat. No. 5,732,414 to Monica, et al., Case No. IPR2016-01646 (14 pages).
Invalidity Chart of U.S. Pat. No. 8,528,118 in Light of U.S. Pat. No. 6,219,850 to Halstead, et al., Case No. IPR2016-01646 (21 pages).
Invalidity Chart of U.S. Pat. No. 8,938,818 in Light of the Wish Book for the 1971 Christmas Season Catalog, et al., Case No. IPR2016-01317 (47 pages).
Invalidity Chart of U.S. Pat. No. 8,938,818 in Light of U.S. Pat. No. 3,729,744 to Rappleyea et al., Case No. IPR2016-01317 (40 pages).
Invalidity Chart of U.S. Pat. No. 8,938,818 in Light of U.S. Pat. No. 5,732,414 to Monica, et al., Case No. IPR2016-01317 (39 pages).
Non-Final Office Action, dated Apr. 17, 2014, Inter Partes Reexamination Control No. 90/012,985 (20 pages).
Non-Final Office Action, dated Jan. 16, 2014, Inter Partes Reexamination Control No. 90/012,985 (17 pages).
Non-Final Office Action, dated Nov. 21, 2013, Inter Partes Reexamination Control No. 95/002,117 (44 pages).
Patent Owner's Preliminary Response, U.S. Pat. No. 8,528,118, Case No. IPR2016-01316 (6 pages).
Patent Owner's Preliminary Response, U.S. Pat. No. 8,938,818, Case No. IPR2016-01317, (7 pages).
Patent Owner's Request to Reopen Prosecution Before the Examiner and New Evidence, dated Apr. 29, 2016, Inter Partes Reexamination Control No. 95/002,117 (8 pages).
Patent Owner's Respondent's Brief, Inter Partes Reexamination Control No. 95/002,117 (17 pages).
Patent Owner's Response to Non-Final Office Action, dated Jan. 21, 2014, Inter Partes Reexamination Control No. 95/002,117 (14 pages).
Patent Owner's Response to the Decision to Institute Inter Partes Review of Certain Claims of U.S. Pat. No. 8,528,118, Case No. IPR2016-01646 (47 pages).
Petition for Inter Partes Review of U.S. Pat. No. 8,528,118, Case No. IPR2016-01316 (91 pages).
Petitioner's Reply Brief in Support of Its Petition for Inter Partes Review of U.S. Pat. No. 8,528,118, Case No. IPR2016-01646 (34 pages).
Petitioner's Request for Rehearing regarding Non-Instituted Claims of U.S. Pat. No. 8,528,118, Case No. IPR2016-01646 (20 pages).
Requester's Response to Patent Owner's Request to Reopen Prosecution Before the Examiner and New Evidence, dated May 25, 2016, Inter Partes Reexamination Control No. 95/002,117 (8 pages).
Response to Non-Final Office Action, dated Jul. 16, 2014, Inter Partes Reexamination Control No. 90/012,985 (13 pages).
Response to Non-Final Office Action, dated Mar. 17, 2014, Inter Partes Reexamination Control No. 90/012,985 (12 pages).
Supplemental Declaration of Michael W. Irvin, dated Dec. 27, 2012, Inter Partes Reexamination Control No. 95/002,117 (2 pages).
1997 JOFA Hockey Equipment Catalog (60 pages).
Athletic Journal Catalog Excerpt, MacGregor E700 Helmet, Jan. 1959 (1 page).
Athletic Journal Catalog Excerpt, vol. 30, No. 4, Dec. 1949 (2 pages).
Athletic Journal Catalog Excerpt, vol. 30, No. 7, Mar. 1950 (2 pages).
Athletic Journal Catalog Excerpt, vol. 30, No. 9, May 1950 (2 pages).
Athletic Journal Catalog Excerpt, vol. 30, vol. 6, Feb. 1950 (2 pages).
Athletic Journal Catalog Excerpt, vol. 31, No. 10, Jun. 1951 (2 pages).
Athletic Journal Catalog Excerpt, vol. 31, No. 4, Dec. 1950 (2 pages).
Athletic Journal Catalog Excerpt, vol. 31, No. 7, Mar. 1951 (2 pages).
Athletic Journal Catalog Excerpt, vol. 31, vol. 6, Feb. 1951 (2 pages).

(56) References Cited

OTHER PUBLICATIONS

Athletic Journal Catalog Excerpt, vol. 32, No. 10, Jun. 1952 (2 pages).
Athletic Journal Catalog Excerpt, vol. 32, No. 2, Oct. 1951 (2 pages).
Athletic Journal Catalog Excerpt, vol. 32, No. 6, Feb. 1952 (2 pages).
Athletic Journal Catalog Excerpt, vol. 32, No. 7, Mar. 1952 (2 pages).
Athletic Journal Catalog Excerpt, vol. 33, No. 8, Apr. 1953 (2 pages).
Athletic Journal Catalog Excerpt, vol. 33, No. 9, May 1953 (2 pages).
Athletic Journal Catalog Excerpt, vol. 34, No. 10, Jun. 1954 (2 pages).

* cited by examiner

FIG. 1
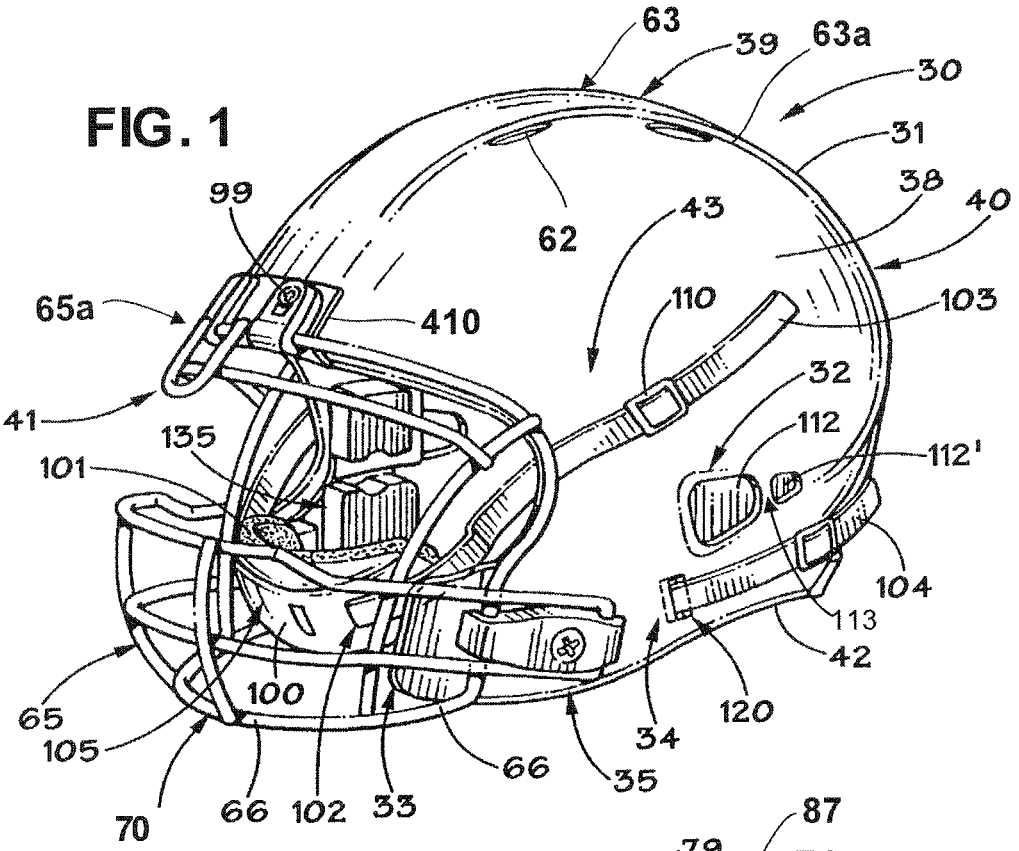
FIG. 3
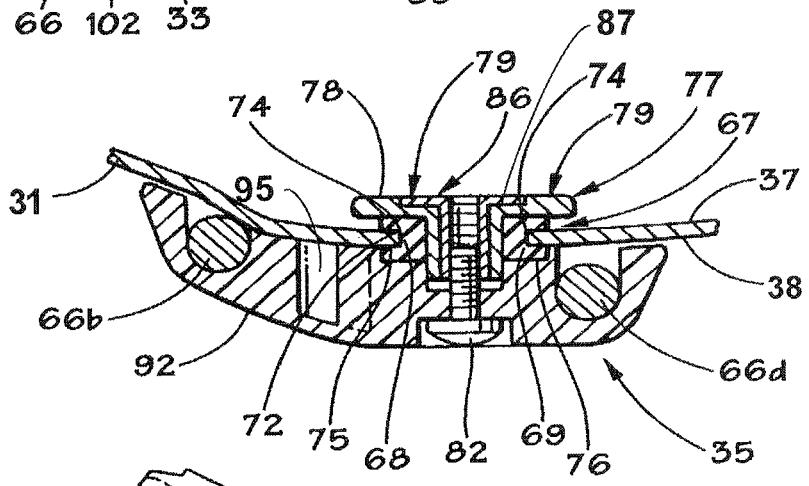
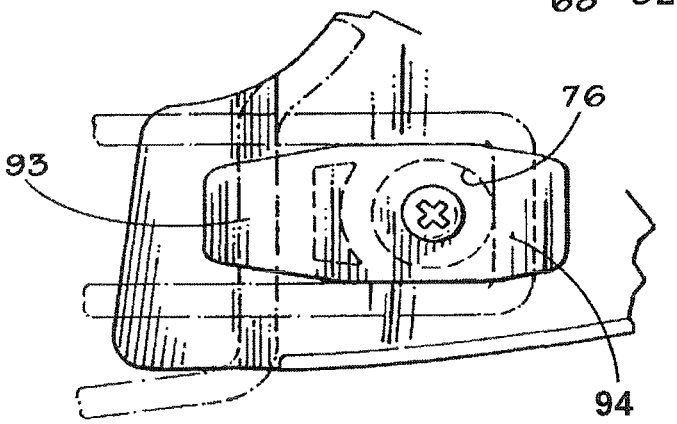
FIG. 4

FIG. 5
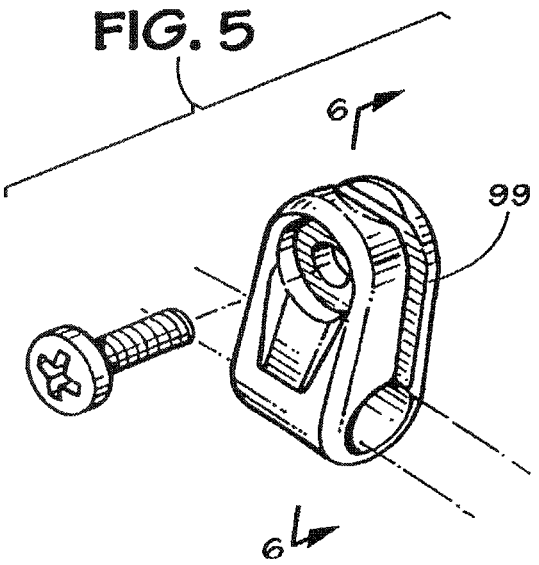
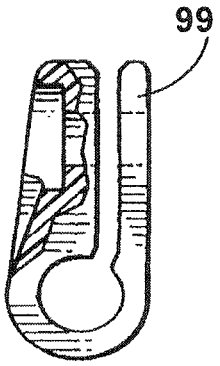
FIG.6
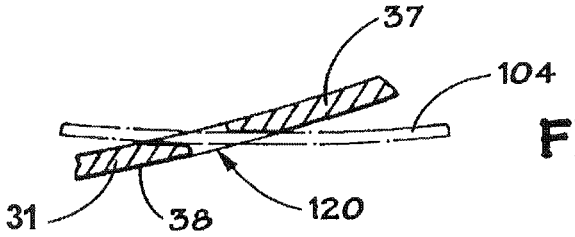
FIG. 7

FIG. 12
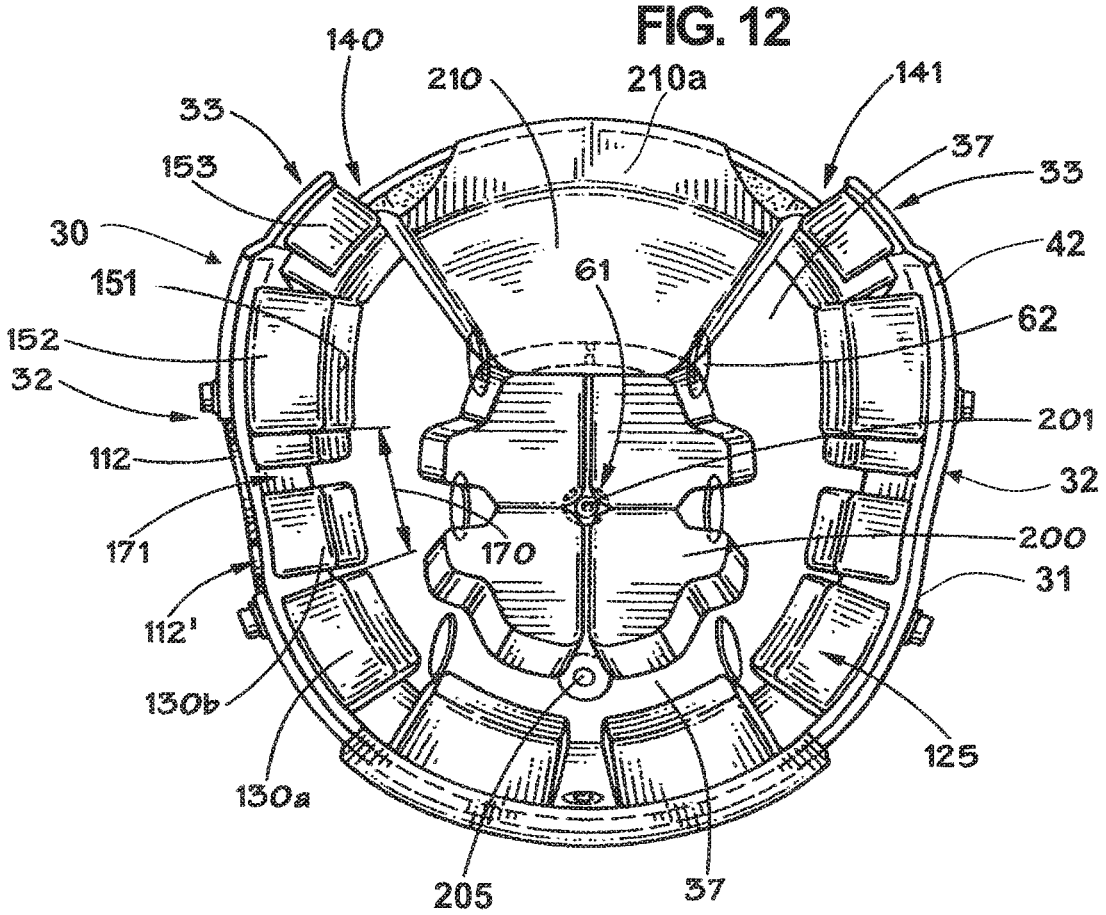
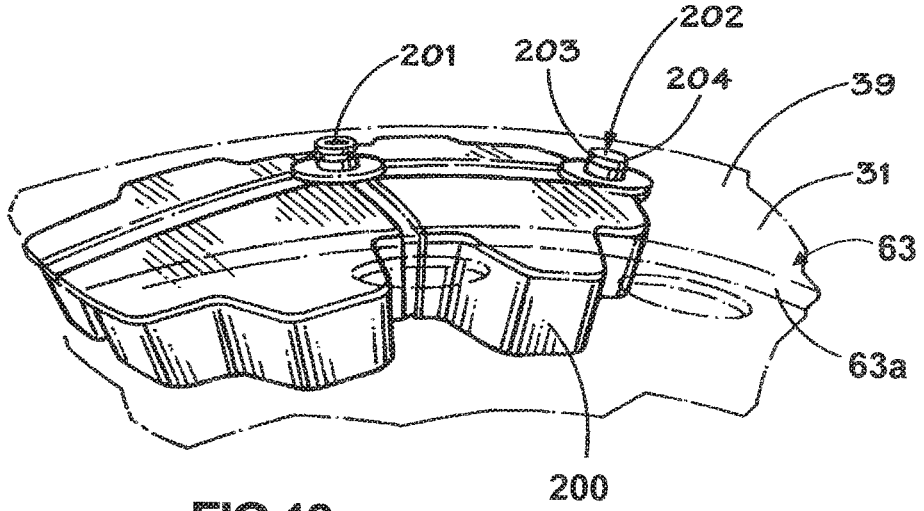
FIG.13

FIG.18
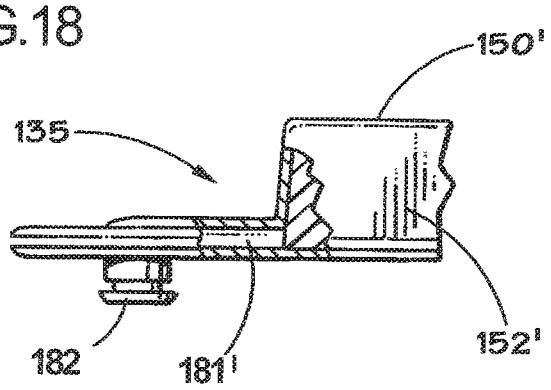
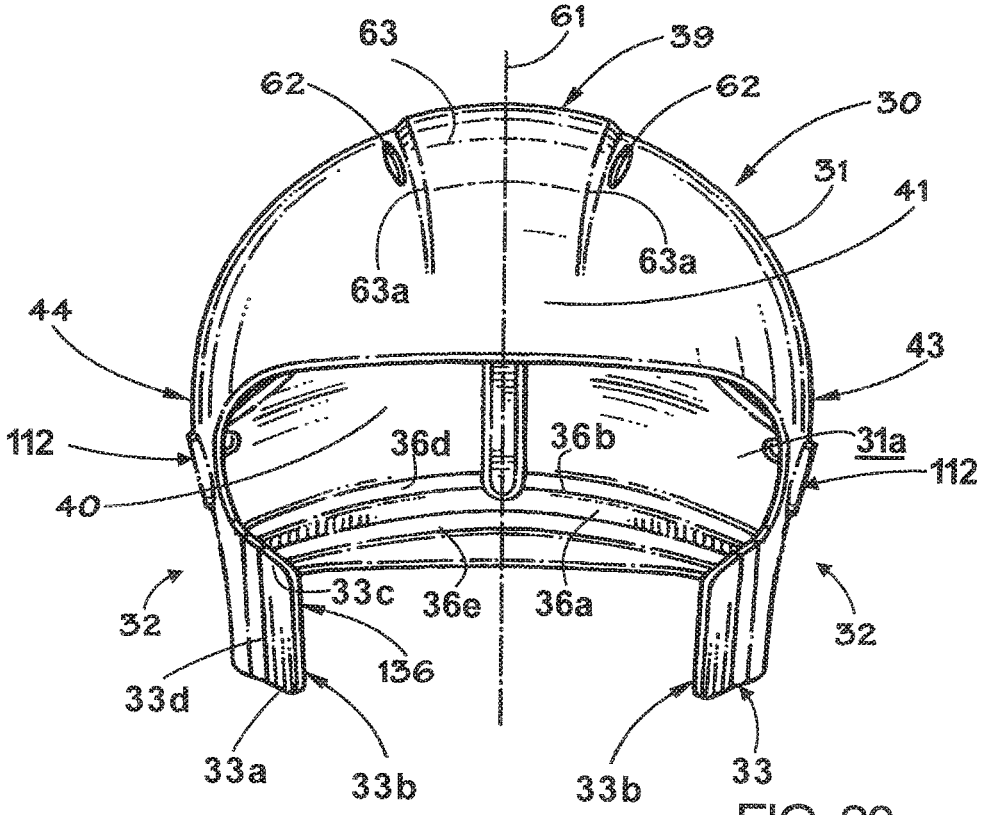
FIG. 20

PROTECTIVE SPORTS HELMET

CROSS-REFERENCE TO RELATED APPLICATIONS

This application is a continuation of U.S. patent application Ser. No. 14/605,765, filed Jan. 26, 2015, to be issued as U.S. Pat. No. 10,143,257, which is a continuation of U.S. Pat. No. 8,938,818, filed on Mar. 15, 2013, which is a continuation of U.S. Pat. No. 8,528,118, filed on Jun. 3, 2011, which is a continuation of U.S. Pat. No. 7,954,177, filed on Jan. 10, 2007, which is a divisional of U.S. Pat. No. 7,240,376, filed on Aug. 18, 2005, which is a continuation of U.S. Pat. No. 6,934,971, filed May 1, 2003, which claims the benefit of Provisional Patent Application No. 60/376,898, filed May 1, 2002, all of which are incorporated in their entirety herein by reference and made a part hereof.

TECHNICAL FIELD

The invention generally relates to a sports helmet, such as a football, lacrosse, hockey or baseball helmet.

BACKGROUND OF THE INVENTION

Various activities, such as contact sports, and in particular the sport of football, require the use of helmets to attempt to protect participants from injury to their heads due to impact forces that may be sustained during such activities. Various types of helmets have been in use in the sport of football, ever since individuals began wearing helmets to attempt to protect their heads many years ago. Typically, these helmets have included: an outer shell, generally made of an appropriate plastic material, having the requisite strength and durability characteristics to enable them to be used in the sport of football; some type of shock absorbing liner within the shell; a face guard; and a chin protector, or chin strap, that fits snugly about the chin of the wear of the helmet, in order to secure the helmet to the wearer's head, as are all known in the art.

Over the years, various improvements have been made to the various components of a football helmet; however, in general, the overall configuration and shape of a football helmet, has remained the same for many years. In this regard, a typical football helmet has included an ear flap as a part of the shell forming the helmet, and the ear flap generally overlies an ear of the wearer and a portion of a cheek of the wearer; however, the jaw of the wearer typically extends outwardly beyond the outer periphery of the helmet, whereby a majority portion of the jaw of the wearer has only been protected by the chin protector.

In general, conventional football helmets presently have ear flaps and the lower portions thereof taper inwardly toward the neck and rearmost portions of the player's jawbone overlied by the ear flaps. As a consequence of this structure, when a player removes his, or her, helmet, it is necessary to pull the sides, or ear flaps, of the helmet outwardly so that the helmet may clear the player's ears. Further in this regard, conventional helmets may also include pads adjacent the player's ear and these pads generally are located along the lower and front edge of the ear flap. These pads must also be pulled away from the ears of the player when removing a conventional helmet. The repeated putting on, and taking off, a football helmet may cause irritation to the player's ear. It would be desirable if the putting on, and removal of, a football helmet did not cause repeated sliding frictional contact with a player's ears, to prevent potential irritation to the player's ear.

Conventional football helmets utilize face guards which are generally made of either a metallic or thermoplastic material. Since a player wears a helmet for a considerable period of time during practices and games, it would be desirable to minimize the weight of the helmet, while not sacrificing protection. The face guards of conventional helmets are typically attached to the sides of the helmet, as well as upon the front of the helmet. Thus, the face guard must extend rearwardly in order to be attached to the side of the helmet. It would be desirable if the size of the face guard could be reduced, thereby reducing the weight of the face guard used in the helmet.

While it is the desire and goal that a football helmet, and other types of protective helmets, prevent injuries from occurring, it should be noted that as to the helmet of the present invention, as well as prior art helmets, due to the nature of contact sports (including football), no protective equipment or helmet can completely prevent injuries to those individuals playing sports. It should be further noted that no protective equipment can completely prevent injuries to a player, especially when the player uses the equipment improperly and/or employs poor form or technique. For example, if the football player uses his football helmet in an improper manner, such as to butt, ram, or spear an opposing player, which is in violation of the rules of football and severe head and/or neck injuries, paralysis, or death to the football player, as well as possible injury to the football player's opponent can result. No football helmet, or protective helmet, such as that of the present invention, can prevent head, chin, or neck injuries a football player might receive while participating in the sport of football. The helmet of the present invention is believed to offer protection to football players, but it is believed that no helmet can, or will ever completely prevent head injuries to football players.

SUMMARY OF THE INVENTION

In accordance with the invention, the foregoing advantages are believed to have been achieved by the football helmet of the present invention. The football helmet of the present invention may include: an outer shell having an inner wall surface and an outer wall surface, the shell including a crown, a back, a front, a lower edge surface, and two sides, the shell being adapted to receive the head of wearer of the helmet, the wearer having a lower jaw having two side portions; each side of the shell includes an ear flap adapted to generally overlie an ear and a portion of a cheek of the wearer; each ear flap generally extending downwardly from its respective side; each ear flap including a jaw flap attached to the ear flap, each jaw flap extending from the ear flap forwardly toward the front of the shell and adapted to generally extend to overlie a side portion of the lower jaw of the wearer of the helmet; each side having a chin protector connector, adapted to connect a portion of a chin protector to the shell; each side having a face guard connector, adapted to connect a portion of a face guard to the shell; and a liner connector, adapted to connect a shock absorbing liner to a portion of the inner wall surface of the shell. Another feature of the present invention is that there may be a face guard connected to at least both sides of the helmet by the face guard connectors, each face guard connector including a shock absorber member adapted to substantially omni-directionally distribute an impact force, exerted upon the face guard, throughout the shell. A further feature of this aspect of the present invention is that each shock absorber member may be a grommet disposed in an opening formed in a side of the shell.

In accordance with another aspect of the present invention, the football helmet may include a chin protector having two sides and at least two flexible members associated with each side of the chin protector, the at least two flexible members adapted to engage with one of the chin protector connectors on the sides of the shell. Another feature of this aspect of the invention is that the chin protector connector may include at least two notches formed in the lower edge surface of the shell, with at least one notch being disposed on each side of the shell, and at least one of the flexible members on each side of the chin protector passes through at least one of the notches on each side of the shell. A further aspect of the invention is that the at least two notches may be disposed in the lower edge surface of the shell adjacent each ear flap of the shell. An additional feature of this aspect of the invention is that the chin protector connector may include at least one slot formed in each side of the shell, and at least one of the flexible members on each side of the chin protector passes through the at least one slot.

In accordance with another aspect of the present invention, the football helmet may include a shock absorbing liner associated with the inner wall surface of the shell by the liner connector. An additional feature of this aspect of the present invention is that the shock absorbing liner may include a plurality of resilient members adapted to absorb shock forces exerted upon the shell, and the plurality of resilient members may be disposed along the inner wall surface of the back and sides of the shell, including at least one resilient pad member disposed upon the inner wall surface of a portion of each of the jaw flaps of the shell. A further feature of this aspect of the present invention is that each of the at least one resilient pad members may be formed integral with the plurality of resilient members, or at least one resilient pad member may be releaseably secured to the plurality of resilient members. An additional feature of this aspect of the present invention is that on each side of the inner wall surface of the shell, an ear channel may be formed between at least one of the resilient members of the shock absorbing liner and the at least one resilient pad member disposed upon the inner wall surface of a portion of the jaw flap, and each ear channel may be disposed adjacent an ear opening formed in each flap.

Another aspect of the present invention is that the outer shell may have a vertical, longitudinal axis extending downwardly from the crown of the helmet, and each ear flap may generally lie in a plane which is substantially parallel to the longitudinal axis of the outer shell. Another feature of this aspect of the present invention is that the outer shell of the helmet may have a vertical, longitudinal axis extending downwardly from the crown, and each jaw flap may generally lie in a plane which is substantially parallel to the longitudinal axis of the outer shell.

The football helmet of the present invention, when compared with previously proposed conventional football helmets, is believed to have a number of advantages, including but not limited to: offering protection to football players from impact forces exerted upon the football helmet during the playing of the game of football; providing a football helmet which is easier for the wearer of the helmet to put on and take off, and may minimize irritation to a player's ear; providing additional protection for the jaw region of the wearer; and providing a smaller, thus lighter in weight, face guard.

Other features and advantages of the invention will be apparent from the following specification taken in conjunction with the following drawings.

BRIEF DESCRIPTION OF THE DRAWINGS

FIG. 1 is a perspective view of an embodiment of a sports helmet showing a face guard of the present invention;

FIG. 3 is a cross-sectional view taken along line 3-3 of FIG. 2, showing an embodiment of the face guard and a face guard connector of the present invention;

FIG. 4 is a partial side view of the face guard and the connector of FIG. 3;

FIG. 5 is a perspective view of a face guard mounting clip of FIGS. 1A and 1B;

FIG. 6 is a cross-sectional view of the face guard mounting clip of FIG. 5, taken along line 6-6 of FIG. 5;

FIG. 7 is a partial cross-sectional view of the football helmet of FIGS. 1 and 2, taken along line 7-7 of FIG. 2;

FIG. 12 is a bottom view of the football helmet of FIGS. 1 and 8, with the face guard removed;

FIG. 13 is a partial perspective view of the crown of the football helmet of FIGS. 1 and 1A, showing a crown pad in accordance with the present invention;

FIG. 18 is a partial cross-sectional view of the resilient pad member of FIG. 15 taken along line 18-18 of FIG. 15;

FIG. 20 is a front view of the football helmet of the present invention of both FIGS. 1 and 1A.

While the invention will be described in connection with the preferred embodiments shown herein, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION

Figure 1A:
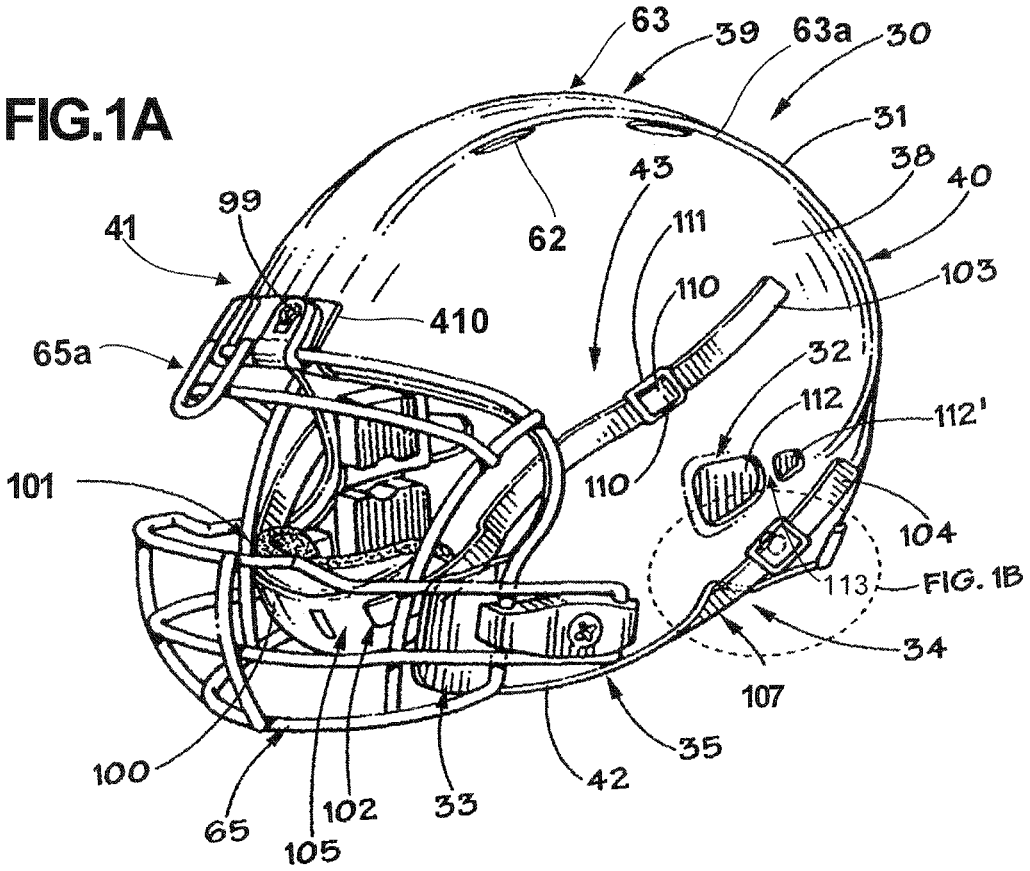
FIG. 1A is a perspective view of another embodiment of a sports helmet showing a face guard of the present invention.
Figure 19:
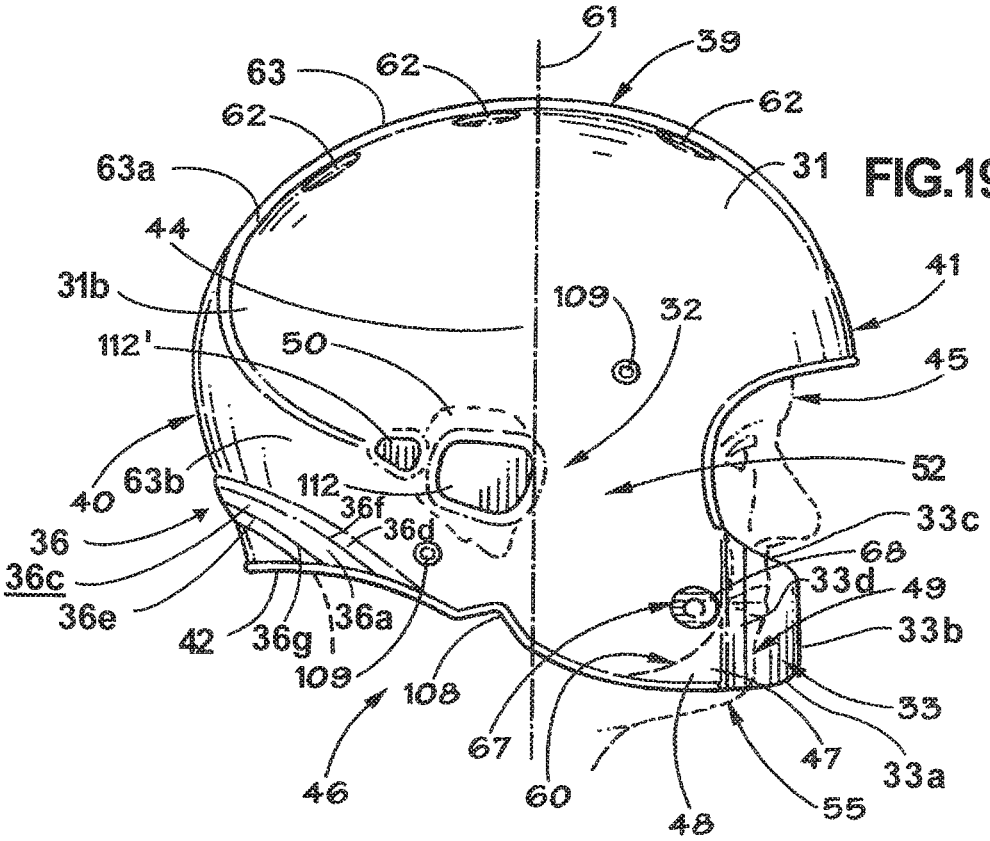
FIG. 19 is a side view of the helmet of the present invention, illustrating the chin protector connecter of the football helmet of FIG. 1A, including a wearer of the helmet being partially shown in phantom lines, including a general outline of a conventional ear flap being also shown in phantom lines.

In FIGS. 1, 1A, and 19, a football helmet 30 in accordance with the present invention is shown to generally include: an outer shell 31, ear flap 32, each ear flap 32 including a jaw flap 33, a chin protector connector 34, a face guard connector 35, and a liner connector (not shown). Outer shell 31 is preferably made of any suitable plastic material having the requisite strength and durability characteristics to function as a football helmet, or other type of protective helmet, such as polycarbonate plastic materials, one of which is known as LEXAN®, as is known in the art. Outer shell 31 has an inner wall surface 37 (FIG. 12) and an outer wall surface 38. Shell 31 further includes a crown region 39, a back (or rear) region 40, a front region 41, a lower edge surface 42, and two side regions 43 (FIGS. 1 and 1A) and 44 (FIG. 19). As is known in the art, and as will be hereinafter described in greater detail, shell 31 is adapted to receive the head 45 of a wearer 46 of the helmet 30, the wearer 46 having a lower jaw 47 (FIG. 19) having two side portions 48 (FIG. 19), only the right side portion 48 of jaw 47 being illustrated. As shown in FIG. 19, the lower jaw 47 terminates generally adjacent to the chin 49 of the wearer's head 45 toward the front of the head 45, and the lower jaw, or mandible 47, generally ends its connection with the upper jaw generally adjacent, and forwardly of ears 50 of wearer 46.

Still with reference to FIGS. 1, 1A and 19, each side region 43, 44 of the shell 31 includes an ear flap 32, the left ear flap 32 being shown in FIGS. 1 and 1A and the right ear flap 32 being illustrated in FIG. 19, and ear flaps 32 are adapted to generally overlie an ear 50 (FIG. 19) and portion of a cheek 52 of the wearer 46. Each ear flap 32 generally extends downwardly from its respective side 43, 44, and in general extends in a direction extending from crown 39 downwardly toward the lower edge surface 42 of shell 31. Each ear flap 32 includes a jaw flap 33, the left hand jaw flaps 33 being illustrated in FIGS. 1 and 1A, and the right jaw flap 33 being illustrated in FIG. 19. Each jaw flap 33 extends from it corresponding ear flap 32 forwardly toward the front 41 of the shell 31, and as seen in FIG. 19 as adapted to generally extend to overlie a side portion 48 of the lower jaw 47 of the wearer 46 of the helmet.

As shown in FIG. 19, jaw flap 33 is shown to extend forwardly to overlie a forwardly disposed portion 55 of lower jaw 47 disposed toward the chin 49 of wearer 46. As illustrated in FIG. 19, jaw flap 33 extends forwardly enough to overlie the side of the chin 49 of wearer 46. In this regard, it should be noted that helmets 30 of the present invention are generally made with outer shells 31 of varying sizes, dependent upon the size of the head of the particular wearer of the helmet. In FIG. 19, helmet 30 is shown superimposed upon what is believed to be an average size head of a wearer of the helmet 30, whereby jaw flap 33 is shown to generally overlie the entire side portion 48 of lower jaw 47, including the forwardly disposed portion 55 of lower jaw 47 adjacent the chin 49 of wearer 46, including overlying the side of the chin 49 of wearer 46. Since FIG. 19 is not a representation of all sizes of heads and all types of chin structures, such as chins which may greatly extend outwardly away from the head of the wearer, it should be understood that it is perhaps possible that someone wearing a helmet 30 in accordance with the present invention may have a slight side portion of his or her chin extending outwardly beyond the outer periphery of jaw flap 33. It is believed that jaw flap 33 will overlie at least the forwardly disposed portion 55 of the lower jaw 47 of virtually all wearers of helmets 30. In this regard, the outer periphery 60, shown in phantom lines in FIG. 19, of a conventional ear flap, without the jaw flap 33 of the present invention generally does not overlie a forwardly disposed portion 55 of the lower jaw, or mandible, 47 of a wearer of a conventional helmet. Furthermore, the ear flap of a conventional football helmet virtually never overlies the chin 49 of a wearer of a conventional helmet.

With reference to FIGS. 12, 19, and 20, the outer shell 31 has a vertical, longitudinal axis 61 generally extending downwardly from crown 39, and each ear flap 32 generally lies in a plane which is substantially parallel to the longitudinal axis 61 of shell 31. Similarly, each jaw flap 33 also generally lies in a plane which is substantially parallel to the longitudinal axis 61 of the outer shell 31. As shown in FIGS. 19 and 20, the jaw flap 33 has a lower edge 33*a*, a front edge 33*b* and an upper edge 33*c*, wherein the front edge 33*b* extends between the lower edge 33*a* and the upper edge 33*c*. The upper edge 33*c* is inclined or angled upward along its length from the front edge 33*b*. An inner boundary 33*d* of the jaw flap 33 (see FIGS. 19 and 20) represents the region where the jaw flap 33 extends from the ear flap 32. The crown 39 of shell 31 may be provided with at least one, and preferably a plurality of ventilation openings, or air vents, 62, which permits the passage of air through shell 31. Vents 62 permit air adjacent the head 45 of wearer 46, which has been heated by being in contact with head 45, to be vented and passed outwardly through openings 62, which may contribute to greater comfort being afforded the wearer 46 of helmet 30. As shown in FIGS. 1, 1A, 13, 19 and 20, the shell 31 includes a raised central band 63 extending across the crown region 39 to the rear region 40. The band 63 may commence near the front region 41 and then extend across the crown region 39 to the rear region 40 of the shell 31. The band 63 has a width defined by a pair of opposed sidewalls 63*a* that extend outward or transversely from the outer surface of the shell 31 (see FIGS. 13 and 19). Preferably, the width of the band 63 increases as it extends across the crown region 39 to the rear region 40. The band 53 also has opposed lower side portions 63*b*, wherein each side portion 63*b* extends from the rear region 40 to a lower portion of the ear flap 32 and terminates proximate the ear opening 112 (see FIG. 19). As shown in FIGS. 19 and 20, the shell 31 includes a first plurality of vent openings 62 aligned along a first side of the raised central band, and a second plurality of vent openings 62 aligned along a second side of the raised central band. As shown in FIG. 12, the lower edge 42 of the shell 31 defines a circumference, and the shell 31 is configured such that the terminal ends of the jaw flaps 33 reside in the same or single quadrant of an X-Y coordinate system.

As shown in FIGS. 19 and 20, the outer shell 31 includes an inner shell wall surface 31*a* (FIG. 20) and an outer shell wall surface 31*b* (FIG. 19). A curvilinear offset band 36 extends around the rear region 40 of the shell 31 and above the lower edge surface 42, and generally between the ear flaps 32, namely between the ear openings 112, 112' in the ear flaps 32. The offset band 36 includes an offset band wall 36*a* having an inner band surface 36*b* (FIG. 20) offset from the inner shell wall surface 31*a*, and an outer band surface 36*c* (FIG. 19) offset from the outer shell wall surface 31*b*. In the illustrated exemplary configuration, the inner band surface 36*b* is recessed with respect to the inner shell wall surface 31*a*, and the outer band surface 36*c* is raised with respect to the outer shell wall surface 31*b*. The offset band 36 also includes a pair of angled transition walls 36*d*, 36*e* extending between the offset band wall 36*a* and the rear region 40. The angled transition wall 36*d* is positioned above the offset band wall 36*a* and extends between the rear region 40 and an upper band edge 36*f* of the offset band wall 36*a*, and the angled transition wall 36*e* is positioned below the offset band wall 36*a* and extends between the rear region 40 and a lower band edge 36*g* of the offset band wall 36*a*. End segments of the offset band 36 curve generally downwardly toward the lower edge surface 42, and in the illustrated exemplary configuration intersect the lower edge surface 42 at a location behind the ear openings 112, 112'.

Figure 8:
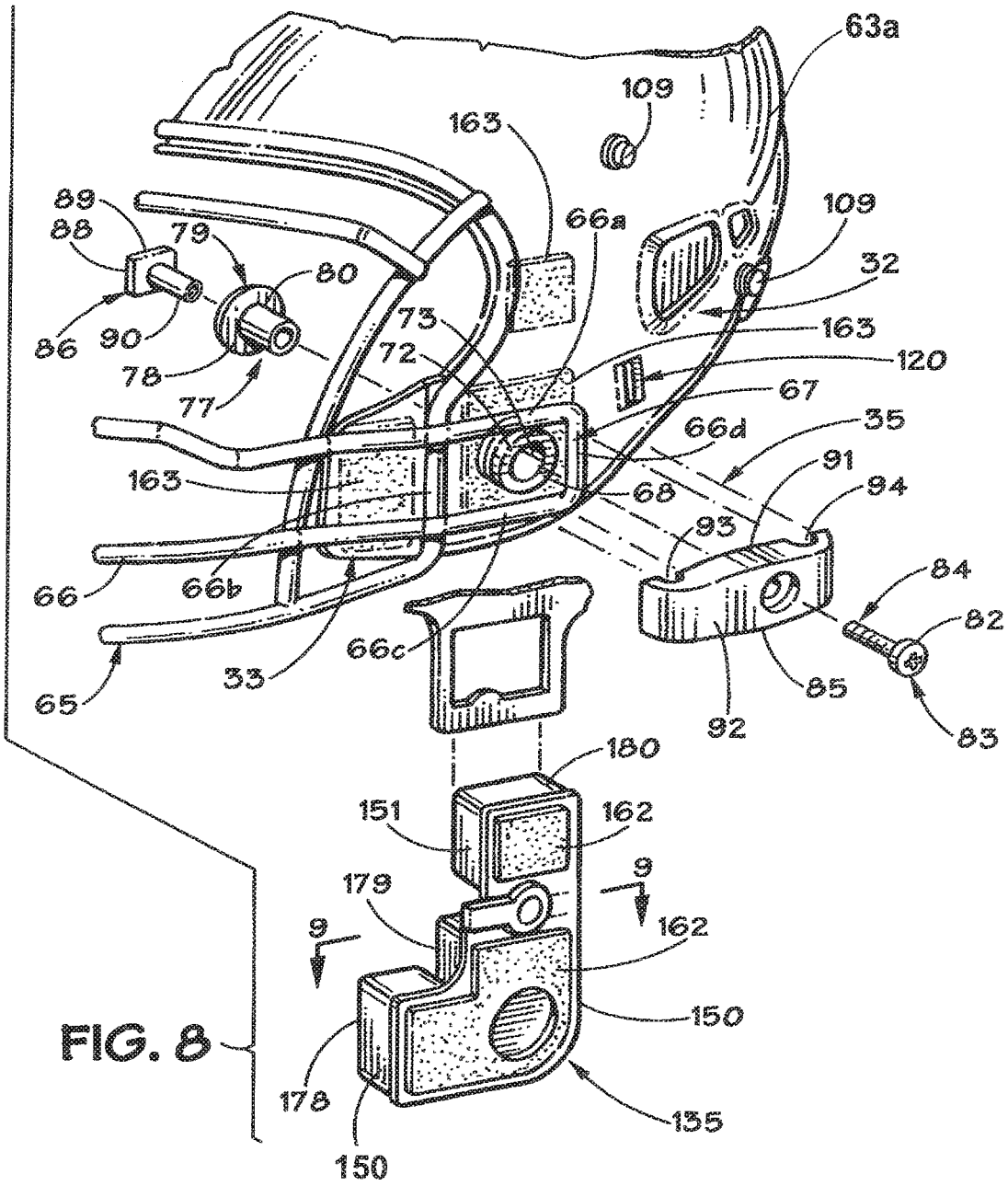
FIG. 8 is a partial exploded view of the football helmet and the face guard of the present invention.
Figure 15:
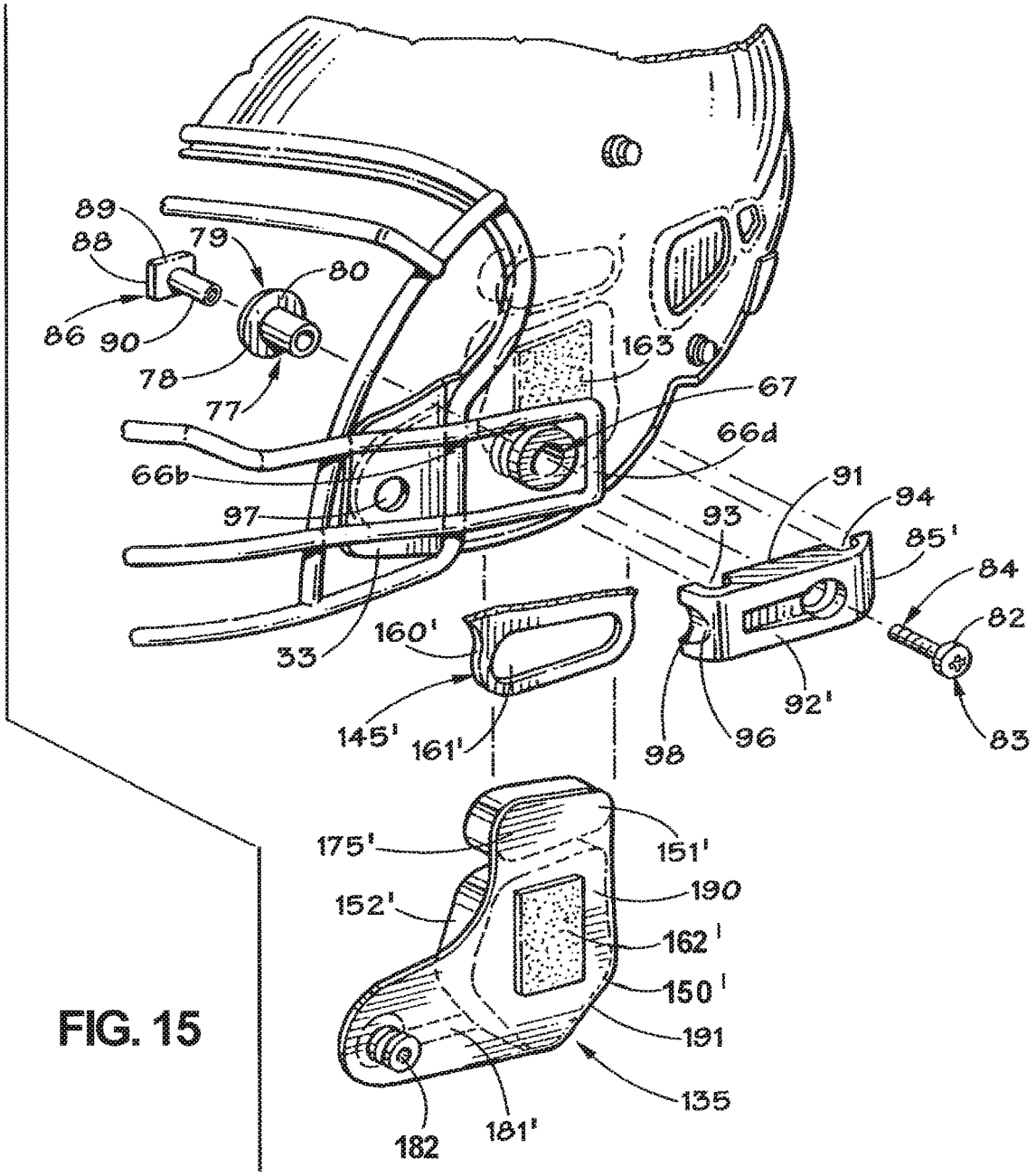
FIG. 15 is a partial exploded perspective view of the helmet and the face guard of the present invention.
Figure 17:
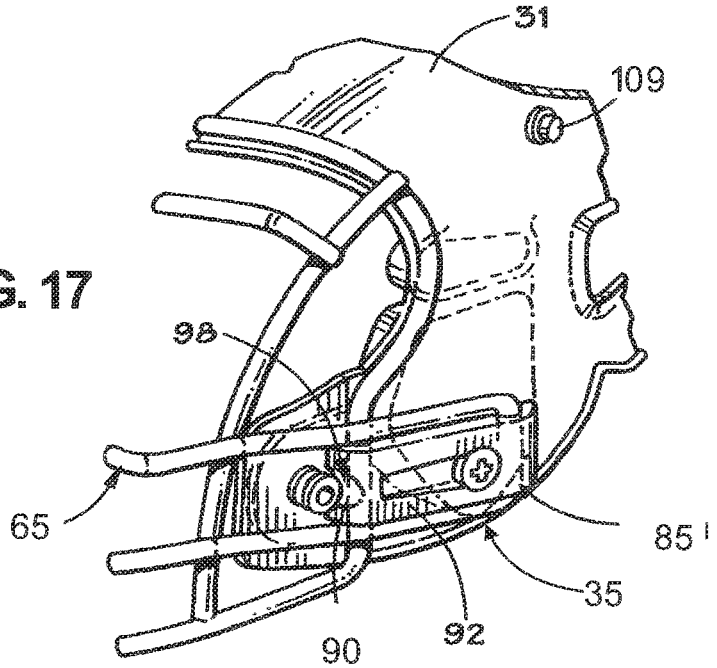
FIG. 17 is a partial perspective view of the face guard and the helmet of FIG. 15.

With reference to FIGS. 1, 1A, 8, and 15, the face guard connector 35 of the present invention will be described in greater detail. Face guard 65 is formed of a plurality of wire members 66, which may be formed of any suitable material having the requisite strength and durability characteristics to function as a football helmet face guard, as is known in the art. The wire members 66 may be preferably formed of a metallic material, such as any suitable steel, and as is known in the art, the wire members 66 may be provided with a suitable plastic coating. Additionally, the wire members 66 may be of a solid or tubular cross-sectional configuration. Alternatively, wire members 66 may be formed of any suitable plastic material, this material also having the requisite strength and durability characteristics to perform the functions of a football helmet face guard. The face guard connectors 35 are adapted to connect a portion of the face guard 65 to shell 31. A face guard connector 35 is disposed on each side 43, 44 of shell 31. One embodiment of face guard connector 35 is shown in FIGS. 1, 1A and 8, while another embodiment of face guard connector is illustrated in FIGS. 15 and 17. In general, the two embodiments of face guard connector 35 are substantially similar, whereby the same components will be described with identical reference numerals, and primed reference numerals will be used in connection with components having the same, or similar functions, but different structures or configurations.

The details of the face guard connector 35 used in connection with the helmet 30 of FIGS. 1, 1A, 2 and 8, are illustrated in FIGS. 3 and 4, whereas the details of construction of the face guard connector 35 of FIG. 15 is illustrated in FIGS. 15 and 17. With reference to FIGS. 3, 4, 8, and 15, face guard connector 35 of the present invention is shown to include a shock absorber member 67 adapted to substantially omni-directionally distribute an impact force, exerted upon the face guard 65, through shell 31. Preferably, each shock absorber member 67 is a grommet 68 disposed in an opening 69 formed in a side 43, 44 of shell 31. Grommet 68 may be formed of rubber, or any other suitable elastomeric material which will function so as to permit substantially omni-directionally distribution of an impact force, exerted upon the face guard 65, throughout shell 31 of helmet 30. Preferably, grommet 68 is formed of synthetic rubber. In this regard, face guard 65 can incur impact forces in a variety of directions during a game of football. For example, as a player strikes the ground upon being tackled, his or her face guard might strike the ground at the lower most center 70 (FIG. 1) of face guard 65, which would be an upwardly exerted force upon face guard 65. Similarly, another player's helmet, or hand, might push downwardly upon the wire member 71 (FIG. 1) of face guard 65, thus exerting a downwardly extending impact force upon face guard 65. Additionally, a player's face guard could be struck in the direction from one of the sides 43, 44 of helmet 30, which would be a side or lateral impact force being exerted upon face guard 65. Of course, it would be readily apparent to one of ordinary skill in the art that an impact force could be exerted upon face guard 65 from any direction in which it is possible to strike, or impact against, face guard 65. As will be hereinafter described in greater detail, as an impact force is exerted upon face guard 65, the shock absorber member 67, or grommet 68, functions to absorb, or attenuate, the impact force exerted upon the face guard, and to substantially omni-directionally distribute the impact force through the shell 31.

Grommet 68 may be a circular shaped member 72 with an opening 73 passing there through. As seen in FIG. 3, each circular shaped member 72 may include an inner, annular, or circular shaped lip 74 that abuts the inner wall surface 37 of the shell 31, and outer, annular shaped lip 75 that abuts the outer wall surface 38 of the shell 31. Each of the face guard connectors 35 has a recess 76 (FIG. 4) which receives a portion of the grommet 68 in a close fitting, abutting relationship as seen in FIG. 3. Preferably, the outer, annular shaped lip 75 is received in the recess 76. As shown in FIGS. 3, 8, and 15, a bushing 77 maybe disposed within the opening 73 which passes through grommet 68. Preferably, the bushing is made of a suitable plastic material having the requisite strength and durability characteristics to function as part of a football helmet face guard connector. Preferably, bushing 77 is formed of a thermoplastic material, such as SURLYN®. Bushing 77 may include a cap member 78 having an upper wall surface 79 (FIG. 3) and a lower wall surface 80 (FIGS. 8 and 15), with the lower wall surface 80 being disposed adjacent the inner wall surface 37 of the shell 31. A bolt 82 having first and second ends 83, 84 may be passed through each bushing and the face guard connector body members, or clips, 85, 85' of each face guard connector 35. A nut 86 receives the second end 84 of the bolt 82.

By bolt 82 being rotatably threaded and rotated with respect to nut 86, face guard 65 may be secured to each side 43, 44 of shell 31. It should be noted that although bolt 82 is inserted from the outside of shell 31, its disposition could be reversed, although it is preferred to be inserted from outside the shell, for ease of removal should a player be injured and it becomes necessary to remove face guard 65. The upper wall surface 79 of each cap member 78 may include a recess 87 which receives a corresponding nut 86. The recess 87 of the cap member 78 preferably matingly receives the corresponding nut 86 and the recess 87 restricts rotational movement of the nut with respect to the shell 31. Preferably, the nut 86 is an I-nut 88, which includes an upper rectangular shaped member 89 and a threaded cylindrical member 90 which is received and disposed within bushing 77.

Each of the face guard connectors 35 of the present invention includes a face guard connector body member 85, 85'. With reference to FIGS. 3, 4, and 8, face guard connector body member 85 will be described. Face guard connector 85 has an inner surface, or inner wall surface, 91, and outer surface, or outer wall surface, 92. Each face guard connector body member 85 has at least two channels 93, 94, disposed in a substantially parallel, substantially non-collinear relationship, each channel 93, 94 receiving a portion of the face guard 65. Preferably, face guard 65 on both of its sides includes a plurality of wire members having a substantial rectangular shaped opening, such as is formed by wire members 66*a*, 66*b*, 66*c* and 66*d* as shown in FIG. 8, with wire members 66*b* and 66*d* being received within channels 93, 94, respectively. Preferably, at least one of the channels 93, 94, is formed in the inner surface 91 of the face guard connector body member 85 and the wire member 66*b*, 66*d* is received within the at least one channel, whereby the wire member 66*b*, 66*d*, is disposed between the inner surface 91 of the face guard connector body member 85, and the outer wall surface 38 of shell 31. Preferably, as shown in FIGS. 3 and 8, both channels, 93, 94 are formed in the inner surface 91 of the face guard connector body member 85. Face guard connector body member 85, as well as face guard connector body member 85', to be hereinafter described, may be made of any suitable material having the requisite strength and durability characteristic to function as part of a face guard connector, such as a thermoplastic material being preferred. An opening 95 may be formed in the face guard connector body member 85 to provide flexibility to body member 85 so that it can more readily conform to the outer contour of the shell 31.

With reference to FIGS. 15 and 17, it is seen that face guard body member 85' is similar in design to that of body member 85. Body member 85' differs from that of body member 85, in that body member 85' includes an access passageway 96 formed in the outer surface 92' of body member 85'. Access passageway 96 is aligned with an inflation port 97 disposed in shell 31, and is adapted to provide access to inflation port 97 and permit the shock absorbing liner, to be hereinafter described, to be inflated. Access passageway may be a semi-circular shaped notch 98 formed at one end of body member 85'.

Helmet 30 as seen in FIGS. 1 and 1A may be provided with conventional face guard clips 99, only one of which is illustrated in FIGS. 1 and 1A, which are used to secure the upper portion 65*a* of face guard 65 to a face guard connection component 410 of the front 41 of shell 31. Referring also to FIG. 12, the face guard connection component 410 is adjacent to the liner 210*a* of the internal brow pad 210. The details of construction of face guard clips 99 are shown in FIGS. 5 and 6. Upon the removal of bolts 82 from face guard connectors 35 and the removal of face guard connector body members 85, 85', face guard 65 may be rotated upwardly about face guard clips 99, in the event that it is necessary to gain access to the face of a player, or to better assist in removing the helmet 30 of a player. In this regard, no tools, other than a screw driver are necessary to remove bolts 82 and face guard connector body members 85, 85'. The frictional forces between bushing 77 and nut 86 restrain nut 86 from rotation while bolt 82 is being unthreaded there from.

Although the face guard connector 35 of the present invention has been described in particular with respect to its use with a football helmet 30, it should be noted that face guard connector 35 could, and in particular, its shock absorber member 67 could be utilized in connection with other types of protective helmets. For example, other types of helmets, with which a face guard of some type is used, include for example, lacrosse helmets, hockey helmets, and baseball batter's helmets, among others.

With reference to FIGS. 1 and 1A, each helmet includes a chin protector connector 34 for connecting a portion of a chin protector 100 to shell 31. Chin protector 100 may be of conventional design and has two sides 101, 102 and at least two flexible members 103, 104 associated with each side 101, 102 of the chin protector. Only flexible members 103, 104, associated with side 102 of chin protector 100 are illustrated. The at least two flexible members, or strap members, 103, 104 are adapted to engage with one of the chin protector connectors 34 on the sides 43, 44 of shell 31. Chin protector 100 may include a conventional chin cup 105 as is known in the art. Two embodiments of chin protector connectors 34, in accordance with the present invention, are shown in FIGS. 1 and 1A.

Figure 1B:
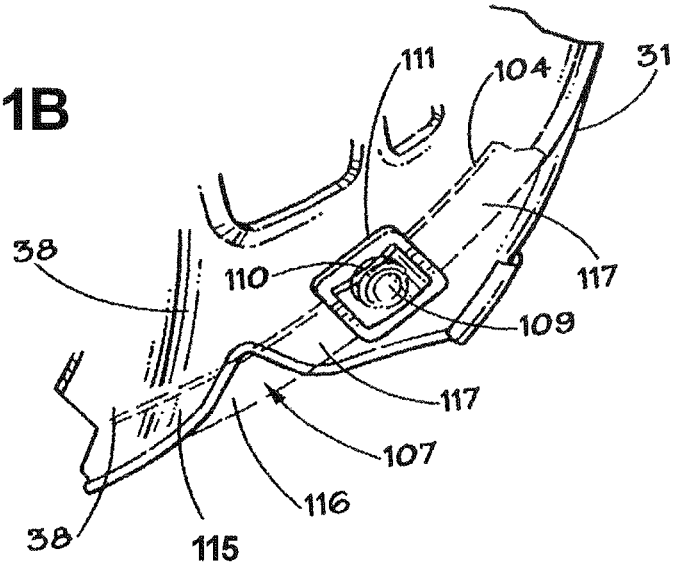
FIG. 1B is a perspective view of the portion of the helmet of FIG. 1A shown within dotted lines 1B.

With respect to FIGS. 1A, 1B, 15, and 19, chin protector connector 34 includes at least two notches 107, 108 (FIG. 19) formed in the lower edge surface 42 of shell 31, with at least one notch being disposed on each side 43, 44 of the shell 31. As shown in FIG. 1A. and 1B, at least one of the flexible members 103, 104 on each side of the chin protector 100 passes through at least one 107 of the notches 107, 108 on each side 43, 44 of the shell 31. Preferably, only one notch is formed in the shell 31 on each side 43, 44 of the shell; however, if desired, additional notches could be formed on the sides of the shell. Preferably, notches 107, 108 are generally V-shaped notches; however, other shapes of notches, if desired, could be utilized. As shown in FIGS. 1A and 1B, flexible member, or flexible strap member 104 passes through notch 107. As is known in the art, chin protector 100 has upper and lower flexible members 103, 104, on each side, and the upper flexible members, or flexible strap members 103 are releaseably secured to the shell 31 as by a conventional snap connector, the male portion of the snap 109 (FIGS. 15 and 19), cooperating with a female snap connector 110 carried by a bracket 111 mounted on upper strap 103 (FIG. 1A).

Figure 2:
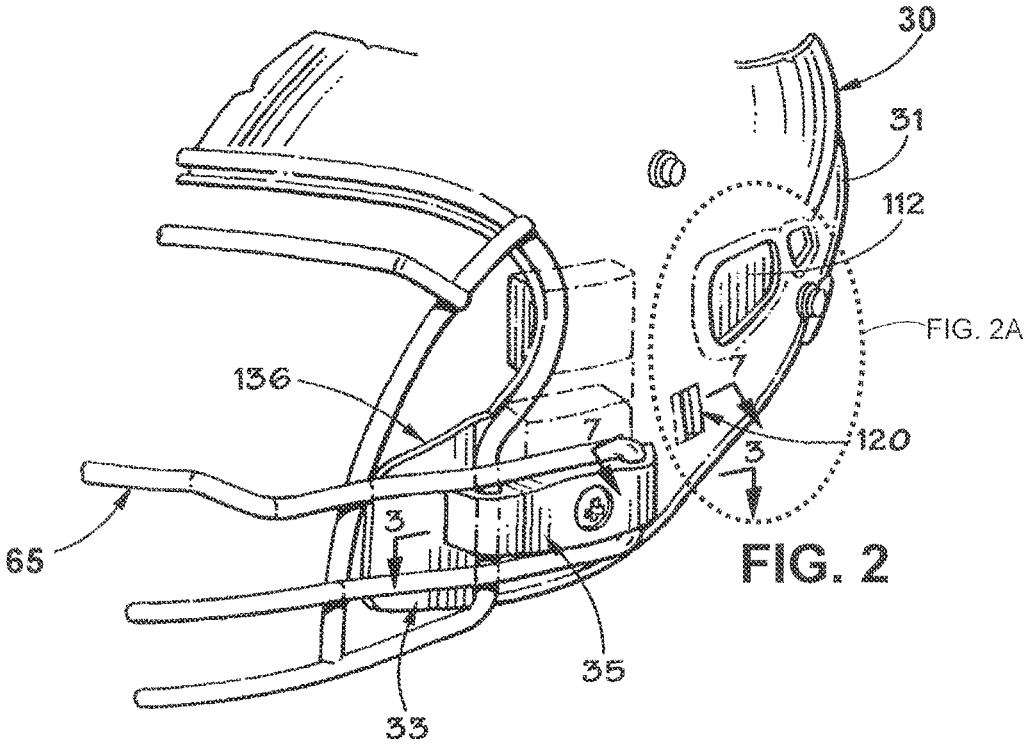
FIG. 2 is a partial perspective view of the helmet and face guard of FIG. 1.
Figure 2A:
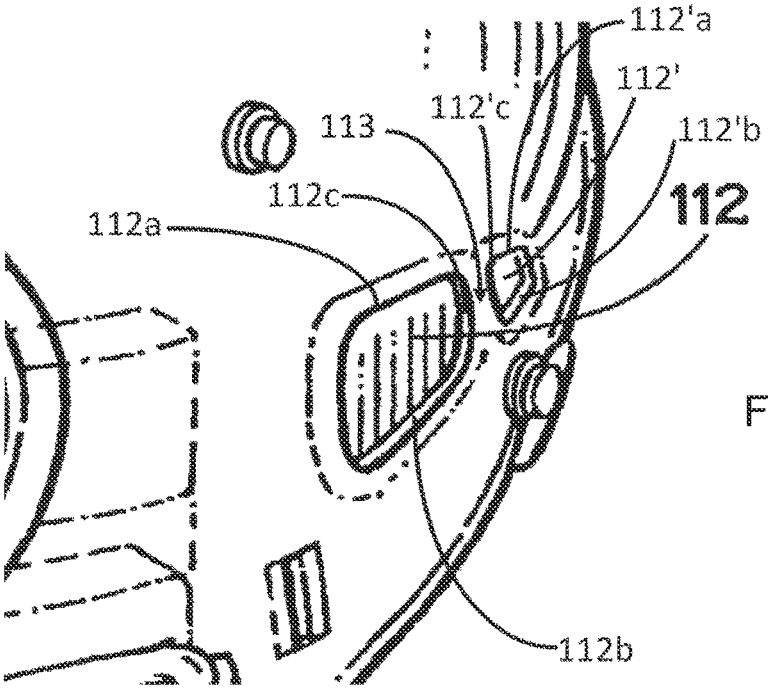
FIG. 2A is a perspective view of the portion of the helmet of FIG. 2 shown within dotted lines 2A.

Helmets 30 are each provided with an ear opening 112 in each ear flap 32, and the ear opening 112 is adapted to be disposed adjacent an ear 50 of the wearer 46 permit the transmission of sound to the wearer 46. Ear openings 112, 112' may be provided with a generally rounded edge configuration that defines an area of the ear opening. Ear openings 112, 112' generally have a non-circular, truncated triangular shaped configuration. As shown in at least FIGS. 1, 1A, 2, 2A, 8, 15, a second smaller opening 112' is disposed rearwardly of the first or main ear opening 112. A strip portion 113 of the shell 31 is positioned between the front ear opening 112 and the rear ear opening 112', wherein the strip 113 has a width (defined between the rear edge 112*c* and the frontal edge 112') and a length (defined between upper edges 112*a*, 112'*a* and bottom edges 112*b*, 112'*b*). The width of the strip 113 is less than the length of the strip 113. Referring to FIGS. 2 and 2A, the ear openings 112, 112' have upper edges 112*a*, 112'*a* and bottom edges 112*b*, 112'*b*, wherein the upper edges 112*a*, 112'*a* collectively contain at least three points that are collinear and the bottom edges 112*b*, 112'*b* collectively contain at least three points that are collinear. Additionally, at least an extent of the upper edge 112*a* is substantially aligned with the upper edge 112'*a* and at least an extent of the bottom edge 112*b* is substantially aligned with the bottom edge 112'*b*. Further, an extent of the rear edge 112*c* of the front ear opening 112 is substantially parallel to the frontal edge 112'*c* of the rear opening 112'. Preferably the notches 107, 108 are disposed in the lower edge surface 42 of the shell 31, and as seen in FIG. 19, and the notches 107, 108 are preferably disposed substantially, directly below the ear openings 112, 112'. As seen in FIGS. 1A and 1B, a first portion 115 of each lower flexible member 104 is disposed adjacent the inner wall surface 37 of shell 31, a second portion 116 of strap member 104 passes through notch 107, and a third portion 117 of the flexible member, or lower strap member 104 is disposed adjacent the outer wall surface 38 of shell 31. The third portion 117 of each lower strap member 104 is preferably releaseably secured to a portion of the chin protector connector 34 disposed on the outer wall surface 38 of shell 31. Preferably, strap 104 is releaseably secured by a male and female snap connector 109, 110, and bracket 111, as previously described. The foregoing described chin protector 100 is generally referred to as a 4 point hookup, or a "high hookup" chin protector, or chin strap, which is believed to provide better stability of the helmet 30 with respect to the wearer's head, particularly upon the player sustaining an impact force to helmet 30.

Because as previously described, the ear flaps 32 of the present invention are generally disposed to lie in a plane which is substantially parallel to the longitudinal axis 61 of the outer shell 31, the notches 107, 108 of chin protector connector 34 serve to provide improved stability of the lower chin straps, or flexible members 104, by preventing the lower strap 104 from being free to slide around the outer wall surface of ear flaps 32. The notches 107, 108 are believed to effectively "catch" the lower strap member 104 to prevent the free sliding of the lower chin strap 104. In general, if a helmet 30 is subjected to a downward impact force upon face mask 65, helmet 30 tends to roll forwardly around a virtual pivot point located slightly above the ear openings 112, 112'. This rolling effect is typically resisted by a force acting between the lower strap connectors 109, 110 and the chin 49 of the wearer of the helmet. The further away from the virtual pivot point the lower snap connection of lower chin strap 104 is located, the better the resistance of the helmet 30 to rolling. Notch 107 assists in resisting the undesired rolling effect by redirecting the strap's force line of action to a location farther away from the virtual pivot point.

With reference to FIGS. 1 and 2 and 7, another embodiment of the chin protector connector 34 of the present invention will be described. In this embodiment, chin protector connector 34, at least one slot 120 is formed in each side 43, 44 of shell 31, and at least one of the flexible members 103, 104, passes through the at least one slot 120. Preferably, the at least one slot 120 is formed in each side 43, 44 of shell 31, and the at least one slot 120 is disposed in each ear flap 32 of shell 31. Preferably, only one slot 120 is provided for each side of the shell 31. Additionally, the at least one slot 120 is preferably disposed forwardly of each ear opening 112 and is positioned between the front 41 of the shell and each ear opening 112. As shown in FIG. 7, slot 120 is tapered with respect to the inner and outer wall surfaces 37, 38 of the shell, whereby sharp edges are avoided which could damage flexible member or strap member, 104. Strap member 104 is also releaseably secured to shell 31 as by use by a female and male snap connector and bracket 109-111, as previously described. Upon releasing the lower snap connections associated with lower strap members 104, the chin protector 104 may be loosened with respect to the chin of the wearer of the helmet, whereby the wearer of the helmet may remove helmet 30 from his or her head. It is not necessary to disengage, or unsnap, the upper flexible strap members 103, in order to remove helmet 30.

Helmets 30 of the present invention preferably include a shock absorbing liner 125 associated by the liner connector with the inner wall surface 37 of shell 31. Preferably, the shock absorbing liner 125 is releaseably connected to the inner wall surface 37 of shell 31 by the liner connector. Preferably the liner connector includes a hook and loop fastener assembly, which is generally referred to as a VELCRO® attachment, as by placing portions of the hook and loop assembly on the shock absorbing liner 125 and the inner wall surface 37 of the shell 31, as is known in the art.

Figure 14:
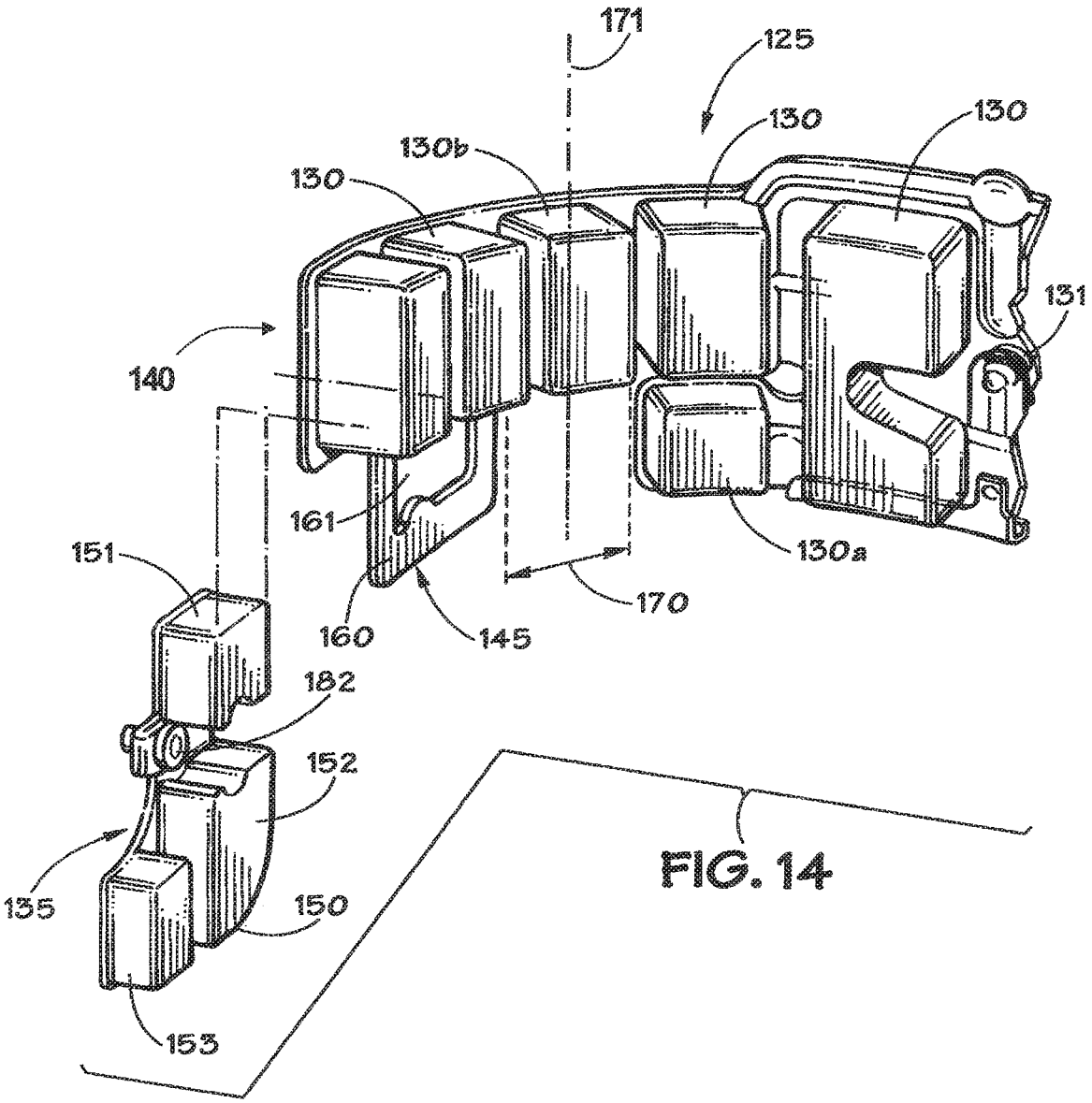
FIG. 14 is a partial perspective view of a shock absorbing liner in accordance with the present invention, corresponding to the shock absorbing liner shown in FIGS. 8 and 12.
Figure 16:
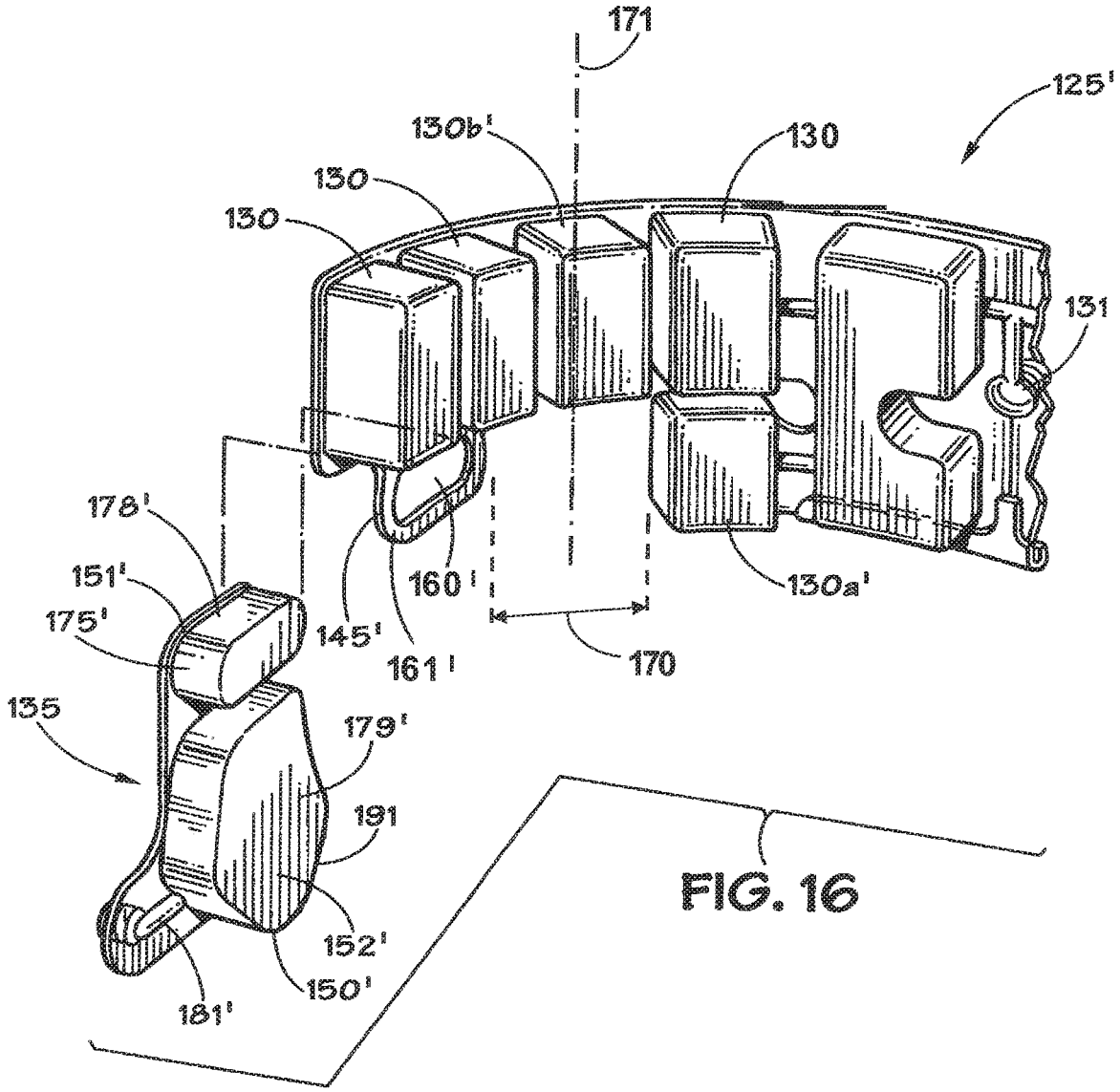
FIG. 16 is a partial perspective view of another shock absorbing liner provided with another embodiment of the resilient pad member, of the present invention, as is shown in FIG. 15.

As shown in FIGS. 14 and 16, shock absorbing liner 125 generally includes a plurality of resilient members 130 which are adapted to absorb shock forces exerted upon the shell 31, and the plurality of resilient members 130 are disposed along the inner wall surface 37 of the back 40 and sides 43, 44 of shell 31. The general construction of shock absorbing liner 125 is disclosed in U.S. Pat. No. 5,263,203, commonly assigned with the present application, and which patent is herein incorporated by reference. Shock absorbing liners 125, 125' may each include an inflation valve 131 which would mate with an opening, or port, disposed in the rear 40 of the shell 31, whereby shock absorbing liners 125, 125' could be inflated as desired. Shock absorbing liners 125, 125' each include at least one resilient pad member 135 disposed upon the inner wall surface 136 of a portion of each of the jaw flap 33 of shell 31. Two embodiments of resilient pad members 135 are illustrated. The first embodiment of resilient pad member 135 is shown in FIGS. 1, 1A, 2, 8, 12, and 14. Another embodiment of resilient pad member 135 is illustrated in FIGS. 15 and 16. Although the at least one resilient pad member, or jaw pad, 135 could be formed integral with the plurality of resilient pad members 130 of shock absorbing liners 125, 125', the resilient pad members 135 are preferably releaseably secured to the plurality of resilient members 130 forming shock absorbing liner 125. As seen in FIGS. 14 and 16 each of the shock absorbing liners 125, 125' have first and second ends 140, 141, and the shock absorbing liners 125, 125' have a connector member 145, 145' disposed at each of the ends 140, 141. Each of the connector members 145, 145' are adapted to connect to the shock absorbing liner 125, 125' at least one of the resilient pad members 135 disposed upon the inner wall surface 136 of a portion of the jaw flap 33.

As shown in FIGS. 8 and 14, one embodiment of the at least one resilient pad member 135, may be jaw pad 150. Another embodiment of the at least one resilient pad member 135 may be seen in FIGS. 15 and 16 as jaw pad 150'. Each of the resilient pad members 135, or jaw pads 150, 150' include at least one, and preferably three resilient pad members 151, 152, 153, in the case of the embodiment of jaw pad 150, and two resilient pad members 151' and 152' in the embodiment of resilient pad member 135, or jaw pad 150' of FIG. 16. As previously described, each of the resilient pad members 135, or jaw pads 150, 150', are releaseably secured to the resilient members 130 of the shock absorbing liners 125, 125' by a connector member 145, 145'. Preferably the connector member 145, 145' is a sling 160, 160', that suspends at least at least one of the resilient pad members that comprise jaw pads 150, 150'. For example, as shown in FIGS. 1A, 8 and 14, resilient pad member 151 is suspended from sling 160. Similarly, as shown in FIGS. 15 and 16, resilient pad member 151' of jaw pad 150' is suspended from sling 160. Sling 160 has an opening 161 that receives the outer configuration, or periphery, of resilient pad member 151 therein, preferably in a closely conforming or mating, snug fitting relationship. Similarly, sling 160' has an opening 161' which receives the outer periphery of resilient pad member 151' of jaw pad 150', again in preferably a mating, snug fitting relationship. It should be noted that since each of the jaw pads 150, 150' also include some hook and loop fastener material such as VELCRO®, 162, 163 (FIG. 8) and 162', 163' (FIG. 15), to releaseably secure jaw pads 150, 150' to the inner wall surface 37 of shell 31, and preferably to the inner wall surface 136 of a portion of the jaw flap 33 of the shell 31, the mating relationship between the resilient pad members 151, 151' with openings 161, 161' is not required to be a snug, frictional relationship. It may rather be a loose fitting relationship for positioning purposes only, to position the jaw pads 150, 150' in their desired location. With the hook and loop fastener material 162, 163 and 162' and 163' acting to releaseably secure the jaw pads 150, 150'.

With reference to FIGS. 12 and 14, when shock absorbing liner 125 is associated with the inner wall surface 37 of shell 31, including the at least one resilient pad member 135, or jaw pad 150 being associated with shock absorbing liner 125, an ear channel 170 is formed on each side of the shell 31 between at least one of the resilient members 130 of the shock absorbing liner 125 and at least one resilient pad member 135, or jaw pad 150. Each ear channel 170 is disposed adjacent the ear openings 112, 112' formed in ear flaps 32. For example, with reference to FIGS. 12 and 14, ear channel 170 is formed and bounded by on one side, by resilient member 130*a*, and on the other side by resilient pad members 151 and 152. The upper end of ear channel 170, as illustrated, is bounded by resilient member 130*b*. Similarly, as seen in FIG. 16, ear channel 170 is bounded by resilient member 130*a* on one side, and by resilient pad members 151' and 152' on the other side. The top of the ear channel 170 may be bounded by resilient member 130*b*'. Each of the ear channels 170 preferably extends along an axis 171 which is disposed substantially parallel with the substantially vertical, longitudinal axis 61 of the shell 31 extending from the crown 39 of the shell 31 to the lower edge surface 42 of the shell 31 adjacent the ear flap 32. The ear channels 170 are thus substantially unobstructed from the ear opening 112 to the lower edge surface 42 of the shell 31 below the ear openings 112, 112', whereby the wearer of the helmet may easily put on, or take off, the helmet 30 without substantial contact between the ear of the wearer and the resilient members 130 and resilient pad members 135 of the shock absorbing liners 125, 125'. It is believed that ear channels 170 will help prevent and/or minimize irritation to the player's ear.

Figure 9:
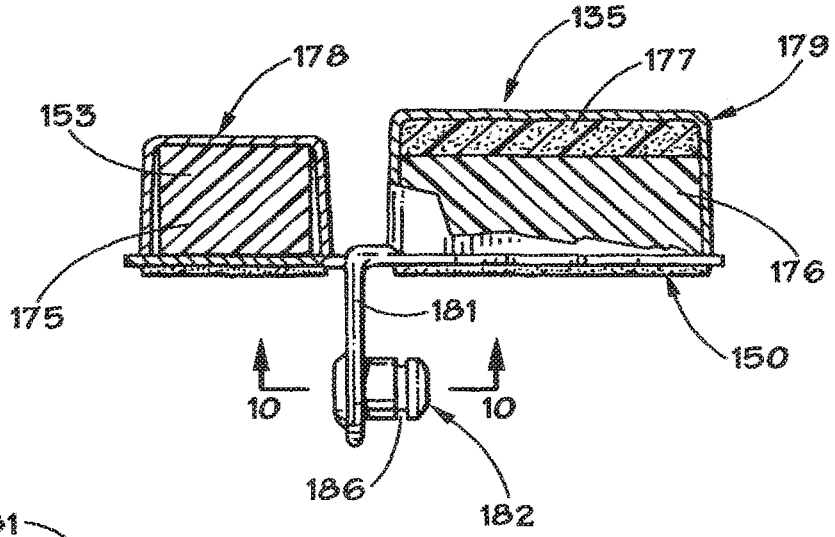
FIG. 9 is a cross-sectional view of the resilient pad member of FIG. 8, taken along line 9-9 of FIG. 8.
Figure 10:
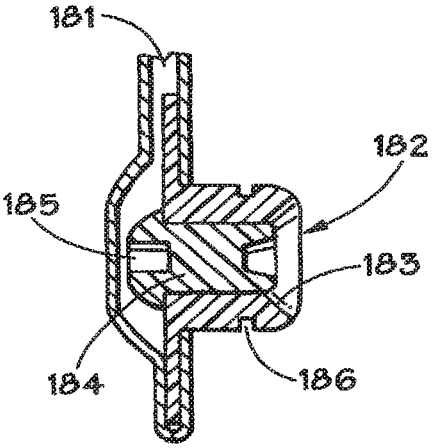
FIG. 10 is a partial cross-sectional view of the resilient pad member of FIGS. 8 and 9 taken along line 10-10 of FIG. 9.
Figure 11:
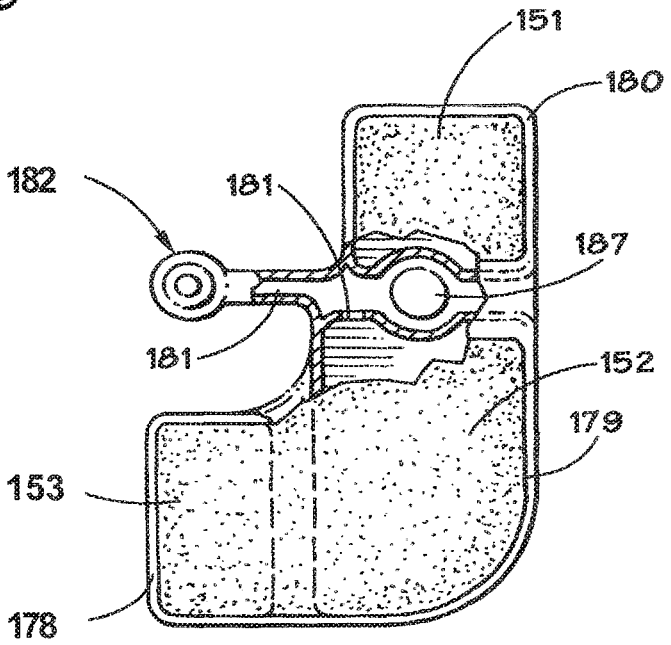
FIG. 11 is a side view of the resilient pad member of FIGS. 8-10.

With reference to FIGS. 8-11, the details of construction of jaw pad 150 are illustrated. In general, the resilient pad member 135, or pads 151, 152, 153, may include a layer of padding material 175, or two layers of padding material 176, 177 disposed in a chamber, or housing, 178, 179, 180. The chambers 178-180 may be formed of any suitable plastic material having the requisite strength and durability characteristics, as is known in the art, to function as resilient members, or pad members, for a football helmet. If desired, all of the chambers 178-180 could be filled with a single layer of padding material, or some of the chambers could be filled with a single layer, and other chambers could be filled with two or more layers of padding material. Alternatively, at least one of the resilient pad members 135, or pads 151-153 could also include a fluid such as a pressurized fluid, such as air. In the embodiment of jaw pad 150 shown in FIGS. 8-11, pads 151 and 153 are filled with a single layer of padding material, and pad 152 in addition to at least one layer 176 of padding material includes a fluid, and the fluid may be pressurized. Preferably, the fluid is air. As shown in FIG. 9, pad 152 preferably includes within its respective housing, or chamber, 179, two layers of padding material, 176, 177. A variety of different padding materials can be used for layers 175-177. For example, PVC nitrile foam, rubber foam, or polyurethane foam are examples of foam padding materials which may be utilized, as are known in the art. When multiple layers of padding material are utilized, such as in pad 152, the first layer of 176 may be one of the foregoing types of foam materials, which is generally referred to as an energy, or force attenuating, foam, and the second layer of foam padding material 177 is a "softer" foam, generally referred to as a fitting, or comfort, foam, as is known in the art. Examples of materials in construction of the foregoing described pads may also be found in U.S. Pat. No. 3,882,547, which is also commonly assigned to the present assignee of this application, which patent is incorporated herein by reference. The pressurized fluid, or air, may be provided to the interior of chamber, or housing, 179, as by an air channel 181 in fluid communication with the interior of housing 179 at one end, and in fluid communication at its other end with a suitable inflation valve 182. Inflation valve 182 may include an inlet orifice 183 which permits access to a conventional, compressible needle valve member 184 which has an exit orifice 185 in fluid communication with air channel 181. A conventional hand held pump having a conventional inflation needle may be inserted through the needle valve member 184, as is known in the art, to provide the desired amount of pressurized fluid, or air into air channel 181, to thus inflate chamber, or housing, 179, as desired. The inflation of chamber 179, in combination with the foam padding material contained therein may assist in properly sizing the helmet, including jaw pad 150, to the shape of the head of the wearer of the helmet. Air channel 181 may be formed by any conventional plastic material formed in the shape of air channel 181, such as by two layers of a suitable thermoplastic material which are heat sealed together into the configuration shown in FIGS. 9 and 11. Inflation valve 182 may include an annular seat 186 which is received within the confines of opening 187 when inflation valve 182 is folded back upon jaw pad 150 after pad 152 has been inflated, as desired, as shown in FIG. 14.

With reference to FIGS. 15 and 16, jaw pad 150' may be similar in construction to jaw pad 150. Pad 151' may also include a chamber 178' which may include a single, solid layer of foam 175', and the pad 152' may, if desired, have multiple of layers of foam disposed within chamber, or housing 179'. If it is desired to provide for a fluid within chamber 179', pad 150' may also include an inflation valve 182 as previously described, in fluid communication with an air channel 181', which in turn is in fluid communication with the interior of chamber 179'. As shown in FIG. 15, inflation valve 182 for pad 150' is associated with an inflation port 97, disposed in the outer wall surface 38 of shell 31, inflation port 97 in turn passing through the shell 31 to the inner wall surface 37 of shell 31. Thus, the inflation valve 182 of jaw pad 150' is accessible from the exterior of shell 31, whereas inflation valve 182 of pad 150 is accessible from within shell 31. Chamber, or housing, 179 for pad 152' of jaw pad 150' may have any suitable outer configuration; however, a generally polygonal configuration as illustrated in FIG. 16. The two outer wall surfaces 190, 191 of chamber 179', which define one side of ear channel 170 are of a generally rounded shape, with no sharp protrusions extending into ear channel 170. Housing, or chamber 179' of jaw pad 150' may have at least three sides, five sides being illustrated in the embodiment of FIGS. 15 and 16. It should be readily apparent to one of ordinary skill in the art that jaw pad 150' may have more than three sides, as well as could have only an outer circumference, were it to be formed in the shape of a circle.

With reference to FIGS. 12 and 13, a crown shock absorbing pad 200 is preferably disposed adjacent the inner wall surface 37 of shell 31 beneath crown 39. Preferably, crown shock absorbing pad 200 is inflatable, and includes an inflation valve 201 which is aligned and received within an opening (not shown) formed in the crown 39 of shell 31, more specifically in the raised central band 63 of the shell 31, which permits crown shock absorbing pad 200 to be inflated. Crown 200 may also include a positioning member 202, or snap member 203, or push-in-plug 204 which is received within an opening 205 in shell 31, more specifically in the raised central band 63, to position and retain crown pad 200 within shell 31. As shown in FIGS. 12 and 13, the inflation valve 201, the positioning member 202, and the opening 205 are disposed between the opposed sidewalls 63*a* of the raised central band 63. In this regard, the opening 205 is defined by and extends through the raised central band 63. Crown shock absorbing pad 200 may be of any suitable construction, and may include a single or multiple layers of a suitable shock absorbing foam material disposed therein. As seen in FIG. 12, the front 41 of shell 31 may include a conventional brow pad 210, as is known in the art, with a liner 210*a*.

As seen in FIGS. 8, 14-17, and 19, the helmets 30 of the present invention, including jaw pads 150, 150', when compared with previously proposed helmets, provide for a substantial amount of energy, or force attenuating, foam, or padding material, disposed in front of the coronal plane of the body of the wearer of the helmet and below the basic plane of the head of the wearer of the helmet. The energy, or force attenuating, foam, or padding material, is preferably a PVC nitrile foam or a polyurethane foam, having a density of at least approximately 5 PCF (pounds per cubic foot) and at least approximately a 25% compression deflection (ASTM D-1056 standard) of 8 PSI (pounds per square inch). As is known to those of skill in this art, the coronal plane is the frontal plane that passes through the long, or longitudinal, axis of the body, and the basic plane is a transverse plane that generally passes through the ears and the lower orbital rims of the eyes of the body.

It is to be understood that the invention is not limited to the exact details of construction, operation, exact materials or embodiment shown and described, as obvious modifications and equivalents will be apparent to one skilled in the art. Accordingly, the invention is therefore to be limited only by the scope of the appended claims.

What is claimed is:

1. A protective sports helmet comprising:

a one-piece plastic shell configured to receive a head of a wearer of the helmet, the shell having:

a front region having a frontal edge, a crown region having a first non-circular vent opening and a second non-circular vent opening, a rear region, and two side regions depending from the crown region, wherein each side region has an arrangement of openings consisting of:

a first non-circular opening formed in the shell and positioned to overlie an ear of the wearer of the helmet, said first non-circular opening having a first opening area, and a second non-circular opening formed in the shell, wherein the entirety of the second non-circular opening is positioned rearward of the first non-circular opening, said second non-circular opening having a second opening area that is less than the first opening area, and an internal pad assembly including a crown pad with an irregular outer periphery, said irregular outer periphery having an arrangement of projections and recesses, the crown pad being positioned against an inner surface of the shell whereby the irregular outer periphery does not fully obstruct the first or second non-circular vent openings.

2. The protective sports helmet of claim 1, wherein, when the helmet is worn by said wearer, neither the first non-circular opening nor the second non-circular opening receives an extent of a chin strap assembly that engages a chin of the wearer.

3. The protective sports helmet of claim 1, wherein the first non-circular opening is defined by a non-circular edge comprised of edge segments that include a top edge oriented towards the crown region and a bottom edge, wherein said top edge is not parallel to said bottom edge.

4. The protective sports helmet of claim 1, wherein the second non-circular opening is defined by a non-circular edge comprised of edge segments that include a top edge oriented towards the crown region and a bottom edge, wherein said top edge is not parallel to said bottom edge.

5. The protective sports helmet of claim 1, wherein:

the first non-circular opening is defined by an arrangement of edge segments that include a top edge that has a length and a bottom edge that has a length;

the second non-circular opening is defined by an arrangement of edge segments that include a top edge that has a length and a bottom edge that has a length;

wherein the length of the top edge of the first non-circular opening is greater than the length of the top edge of the second non-circular opening; and wherein the length of the bottom edge of the first non-circular opening is greater than the length of the bottom edge of the second non-circular opening.

6. The protective sports helmet of claim 1, wherein the first non-circular opening is defined by an arrangement of edge segments that include a top edge that is oriented towards the crown region, wherein the second non-circular opening is defined by an arrangement of edge segments that include a top edge that is oriented towards the crown region; and wherein the top edge of the first non-circular opening and the top edge of the second non-circular opening collectively contain at least three points that are collinear.

7. The protective sports helmet of claim 1, wherein:

the first non-circular opening is defined by an arrangement of edge segments that includes a rear edge oriented towards the rear region;

the second non-circular opening is defined by an arrangement of edge segments that includes a front edge oriented towards the frontal edge; and wherein the shell includes a strip portion located between the rear edge of the first non-circular opening and the front edge of the second non-circular opening, the strip portion having a width that is less than a length of the strip portion.

8. The protective sports helmet of claim 1, wherein:

the first non-circular opening is defined by a combination of edge segments, said edge segments includes a top edge, a bottom edge, and a rear edge oriented towards the rear region;

the second non-circular opening is defined by a combination of edge segments, said edge segments includes a top edge, a bottom edge, and a front edge oriented towards the frontal edge; and wherein: (a) the top edge of the first non-circular opening and the top edge of the second non-circular opening are substantially aligned, (b) the bottom edge of the first non-circular opening and the bottom edge of the second non-circular opening are substantially aligned, and (c) an extent of the rear edge of the first non-circular opening is substantially parallel to an extent of the front edge of the second non-circular opening.

9. The protective sports helmet of claim 1, wherein the shell includes a raised central band, the raised central band having a first side wall that extends outwardly from an outer surface of the shell and a second side wall that extends outwardly from an outer surface of the shell.

10. The protective sports helmet of claim 1, wherein the shell includes:

a raised central band extending across the crown region to the rear region, the raised central band having a first side wall and a second side wall that extend outwardly from an outer surface of the shell, a first non-circular vent opening in the shell, wherein said first non-circular vent opening is positioned substantially adjacent to the first side wall of the raised central band, and a second non-circular vent opening in the shell, wherein said second non-circular vent opening is positioned substantially adjacent to the second side wall of the raised central band.

11. A protective sports helmet comprising:

a plastic shell configured to receive a head of a wearer of the helmet, the shell having:

a front region having a frontal edge, a crown region, a rear region, two side regions depending from the crown region, wherein each side region has a first opening formed in the shell and positioned to overlie an ear of the wearer of the helmet, said first opening having a rear edge oriented towards the rear region and a first opening area, a raised central band extending across the crown region, the raised central band having a first side wall that extends outwardly from an outer surface of the shell and a second side wall that extends outwardly from the outer surface of the shell, a first vent opening in the shell and having an elongated configuration with a length, wherein a distance between an inner edge of said first vent opening and the first side wall of the raised central band defines a first vent opening distance that is less than the length of the first vent opening, and a second vent opening in the shell and having an elongated configuration with a length, wherein a distance between an inner edge of said second vent opening and the second side wall of the raised central band defines a second vent opening distance that is less than the length of the second vent opening.

12. The protective sports helmet of claim 11, wherein the shell further includes a second opening formed in the shell and positioned rearward of the first opening, said second opening having a frontal edge oriented towards the frontal edge; and wherein the shell includes a strip portion located between the rear edge of the first opening and the front edge of the second opening, the strip portion having a width that is less than a length of the strip portion.

13. The protective sports helmet of claim 12, wherein an extent of the rear edge of the first opening is substantially parallel to an extent of the front edge of the second opening.

14. The protective sports helmet of claim 11, wherein the first vent opening and the second vent opening each have an outer edge and an inner edge, and wherein the distance between the outer edges of said vent openings defines a vent opening width; and wherein the helmet further includes an internal pad assembly removably connected to the plastic shell, the internal pad assembly including a front pad and a front liner that extends towards the frontal edge of the shell, wherein the front liner has opposed sides that define a liner width proximate the frontal edge, and wherein said liner width is less than said vent opening width.

15. The protective sports helmet of claim 11, wherein both of the first and second side walls have a curvilinear configuration.

16. The protective sports helmet of claim 11, wherein the raised central band has a first width that extends between the first and second side walls at a location that is positioned between the first and second vent openings and the raised central band has a second width that extends between the first and second side walls at a location that is: (i) in the rear of the shell and (ii) below an extent of the frontal edge of the shell; and wherein the first width of the raised central band is less than the second width of the raised central band.

17. The protective sports helmet of claim 11, wherein the first vent opening has a major axis that is substantially parallel to the first side wall and the second vent opening has a major axis that is substantially parallel to the second side wall.

18. The protective sports helmet of claim 11, further comprising a faceguard assembly having:

a faceguard comprising a plurality of bar members, the faceguard having a left peripheral mounting region and a right opposed peripheral mounting region, wherein the left and right peripheral mounting region include an arrangement of three substantially linear bar members that define a substantially U-shaped interface area, and a faceguard connector bracket having:

a rear segment that includes a receiver configured to receive an extent of one of the three linear bar members segments, and a front segment that includes an opening that receives an elongated coupler that (i) is positioned within the U-shaped interface area and (ii) extends through the shell to secure the faceguard to the side region of the shell.

19. The protective sports helmet of claim 11, further comprising an internal pad assembly, the internal pad assembly has a first padding assembly that includes a plurality of pad members and a second padding assembly that includes a plurality of pad members, wherein the first padding assembly has an opening there through that receives an extent of the second padding assembly.

20. A protective sports helmet to be worn by a player engaged in a sporting activity comprising:

a one-piece plastic shell configured to receive a head of a player, the shell having:

a front region having a frontal edge, a crown region, a rear region, two side regions depending from the crown region, wherein each side region has an arrangement of openings comprising:

a first non-circular opening formed in the shell and configured to overlie an ear of the player, when the helmet is worn by the player, said first non-circular opening is defined by an arrangement of edge segments that includes a top edge oriented towards the crown region and a rear edge oriented towards the rear region, a second non-circular opening formed in the shell and positioned rearward of the first non-circular opening, said first non-circular opening is defined by an arrangement of edge segments that includes a top edge oriented towards the crown region and a front edge oriented towards the frontal edge of the shell, and wherein at least a substantial extent of the top edge of the first non-circular opening is aligned with the top edge of the second non-circular opening.

21. The protective sports helmet of claim 20, wherein the first non-circular opening has a first opening area and the second non-circular opening has a second opening area, wherein the first opening area is greater than the second opening area.

22. The protective sports helmet of claim 20, wherein the shell includes a strip portion located between the rear edge of the first non-circular opening and the front edge of the second non-circular opening, the strip portion having a width that is less than a length of the strip portion.

23. The protective sports helmet of claim 20, wherein:

the edge segments that define the first non-circular opening includes a bottom edge;

the edge segments that define the second non-circular opening includes a bottom edge and a rear edge; and wherein: (a) the bottom edge of the first non-circular opening and the bottom edge of the second non-circular opening are substantially aligned and (b) an extent of the rear edge of the first non-circular opening is substantially parallel to an extent of the front edge of the second non-circular opening.

24. The protective sports helmet of claim 20, further comprising:

a first plurality of elongated vent openings formed in the shell and are aligned with one another;

a second plurality of elongated vent openings formed in the shell and are aligned with one another; and an internal padding assembly removably connected to the plastic shell, said internal padding assembly includes a crown pad that is configured to be positioned against an inner surface of the plastic shell whereby the crown pad does not fully obstruct any vent contained within the first or second plurality of vent openings.

25. The protective sports helmet of claim 20, wherein the rear edge of the first non-circular opening is forward of the frontal edge of the second non-circular opening.

26. The protective sports helmet of claim 20, wherein the length of the top edge of the first non-circular opening is greater than the length of the top edge of the second non-circular opening.

27. The protective sports helmet of claim 1, wherein the shell includes a raised central band, the raised central band having a first side wall that extends outwardly from an outer surface of the shell and a second side wall that extends outwardly from an outer surface of the shell.

28. The protective sports helmet of claim 20, wherein at least one side region of the shell includes a jaw flap configured to overlie a front portion of a lower jaw of the wearer of the helmet.

29. The protective sports helmet of claim 1, wherein at least one side region of the shell includes a jaw flap configured to overlie a front portion of a lower jaw of the wearer of the helmet.

* * * * *